US007316182B2

(12) United States Patent
Westby

(10) Patent No.: US 7,316,182 B2
(45) Date of Patent: Jan. 8, 2008

(54) INK PROOFER ARRANGEMENT INCLUDING LIGHT SOURCE FOR CURING INK

(75) Inventor: Ronald K. Westby, Ramsey, MN (US)

(73) Assignee: Integrity Engineering, Inc., Princeton, MN (US)

( * ) Notice: Subject to any disclaimer, the term of this patent is extended or adjusted under 35 U.S.C. 154(b) by 0 days.

(21) Appl. No.: 11/126,081

(22) Filed: May 10, 2005

(65) Prior Publication Data

US 2005/0241504 A1 Nov. 3, 2005

Related U.S. Application Data

(63) Continuation-in-part of application No. 10/976,194, filed on Oct. 28, 2004, now abandoned, which is a continuation-in-part of application No. 10/219,018, filed on Aug. 14, 2002, now Pat. No. 6,814,001.

(60) Provisional application No. 60/312,595, filed on Aug. 15, 2001.

(51) Int. Cl.
*B41F 31/30* (2006.01)
*B41F 23/04* (2006.01)

(52) U.S. Cl. ..... 101/218; 101/247; 101/329; 101/351.3; 101/424.1

(58) Field of Classification Search ..... None
See application file for complete search history.

(56) References Cited

U.S. PATENT DOCUMENTS 1,442,287 A 1/1923 Mattern
2,118,238 A 5/1938 Smith
2,663,254 A 12/1953 Parrish
2,985,102 A 5/1961 Vandercook (Continued)

FOREIGN PATENT DOCUMENTS

DE 3938405 C1 11/1989

(Continued)

OTHER PUBLICATIONS

American Ink Maker, "*2001 Buyer's Guide Suppliers*," Dec. 2000, pp. 109 and 159.

(Continued)

*Primary Examiner*—Leslie J Evanisko
(74) *Attorney, Agent, or Firm*—Patterson, Thuente, Skaar & Christensen, P.A.

(57) ABSTRACT

An ink proofer arrangement includes an ink proofer tool, a cylindrical drum roller, a drive motor adapted to rotate the roller and a first movable mounting assembly to retain the ink proofer tool adjacent to and in a non-contact position with the roller, a first variable pressure assembly coupled to the mounting assembly and adapted to move the ink proofer tool between a contact with pressure position and a non-contact position with the roller. The ink proofer arrangement also includes a UV light source positioned downstream of the ink proofer tool to more quickly and uniformly dry the inks on the proof substrate. The UV light source may be pivotable to permit access to the proof substrate. The UV light source may be selectively positionable at different distances from the ink proofer tool so as to provide for adjustability of a dwell time for the proof.

20 Claims, 24 Drawing Sheets

U.S. PATENT DOCUMENTS

| | | | | |
|---|---|---|---|---|
| 2,990,715 | A | | 7/1961 | Bradt |
| 2,991,713 | A | | 7/1961 | McFarland |
| 2,998,767 | A | | 9/1961 | Vandercook et al. |
| 3,131,631 | A | | 5/1964 | Haskin, Jr. |
| 3,331,318 | A | | 7/1967 | Augustyn et al. |
| 3,413,918 | A | | 12/1968 | Gingras |
| 3,734,014 | A | | 5/1973 | Oda |
| 3,819,929 | A | | 6/1974 | Newman |
| 4,015,340 | A | | 4/1977 | Treleven |
| 4,015,524 | A | | 4/1977 | Herbert |
| 4,019,434 | A | | 4/1977 | Hoexter |
| 4,048,490 | A | | 9/1977 | Troue |
| 4,072,103 | A | | 2/1978 | Fletcher et al. |
| 4,216,676 | A | | 8/1980 | Bugnone |
| 4,258,125 | A | | 3/1981 | Edhlund |
| 4,434,562 | A | | 3/1984 | Bubley et al. |
| 4,522,057 | A | | 6/1985 | Kerchiss |
| 4,547,780 | A | * | 10/1985 | Cummins ..... 346/9 |
| 4,558,643 | A | | 12/1985 | Arima et al. |
| 4,665,627 | A | | 5/1987 | Wilde et al. |
| 4,852,486 | A | | 8/1989 | Ely et al. |
| 4,984,532 | A | | 1/1991 | Winters |
| 4,989,513 | A | | 2/1991 | Toda et al. |
| 5,099,586 | A | | 3/1992 | Anderson |
| 5,159,602 | A | | 10/1992 | Giordano et al. |
| 5,289,769 | A | | 3/1994 | Lewis |
| 5,485,782 | A | | 1/1996 | Van Der Horst |
| 5,495,800 | A | | 3/1996 | Weissbein et al. |
| 5,615,611 | A | | 4/1997 | Puschnerat |
| 5,754,208 | A | | 5/1998 | Szlucha |
| 5,856,064 | A | | 1/1999 | Chou |
| 6,035,547 | A | | 3/2000 | Hess et al. |
| 6,058,770 | A | | 5/2000 | Engel |
| 6,280,801 | B1 | * | 8/2001 | Schmitt ..... 427/511 |
| 6,378,426 | B1 | | 4/2002 | Furr, Jr. et al. |
| 6,422,143 | B1 | | 7/2002 | Lawrence et al. |
| 6,814,001 | B2 | * | 11/2004 | Westby et al. ..... 101/218 |

FOREIGN PATENT DOCUMENTS

| | | |
|---|---|---|
| EP | 0428767 A1 | 11/1989 |

OTHER PUBLICATIONS

Little Joe Industries, "*Little Joe*," Aug. 14, 2001, 2 pages.
Little Joe Industries, "*Little Joe Offset Proofing Press*," 1 page.
Paramarco Global Graphics, "*Precision Proofer*," Aug. 7, 2001, 6 pages.

* cited by examiner

INK PROOFER ARRANGEMENT INCLUDING LIGHT SOURCE FOR CURING INK

RELATED APPLICATION

This application is a continuation-in-part of U.S. application Ser. No. 10/976,194 filed Oct. 28, 2004, now abandoned which is a continuation-in-part of U.S. application Ser. No. 10/219,018, filed Aug. 14, 2002, now U.S. Pat. No. 6,814,001, which claims the benefit of U.S. Provisional Application No. 60/312,595 filed Aug. 15, 2001, which are hereby incorporated by reference in their entirety.

TECHNICAL FIELD

The present invention relates generally to the fields of flexographic, gravure, and offset printing and, more particularly, to a portable flexographic ink proofing apparatus for providing proofs of ink samples for purposes of color and density correction and press correlation to mimic printing properties.

BACKGROUND OF THE INVENTION

In the field of flexographic printing, ink samples are obtained by drawing ink over a substrate using a hand ink proofer of the type manufactured by Harper Companies International of Charlotte, N.C. The ink is applied to the substrate by manually rolling the hand proofer across the substrate. Manual ink proofer tools are utilized for proofing ink colors in order to accurately predict the results to be obtained by running a selected ink specimen in a printing press. A computer microscope is then used to view the ink smear on the substrate. The computer then indicates to the operator various color components to be added to the ink in order to achieve the desired ink coloration.

In a flexographic printing operation, rubber plates are utilized for delivering the ink to the stock or paper to be printed. A flexographic ink technician is usually given an ink specimen which has been determined to be acceptable for use on a particular press, and a production run sample, to be used as the standard for color and density. One of the most difficult tasks facing a flexographic ink technician is proofing an ink in a manner so that the color will duplicate the color of the production run sample from the flexographic printing press. It is well known among those skilled in the art that if three trained technicians pull an ink proof, using the same ink on the same hand proofer tool, three different color shades will result.

Color shade on a flexographic printing press is dependent on the ink film thickness applied to the substrate or stock. The ink film thickness is determined by the speed of the press, the pressure applied between the printing plate and paper (i.e., impression), and the pressure between the rollers on the printing unit. Similarly, color shade on a flexographic hand proofer tool is also dependent on the ink film thickness applied to the substrate which thickness is determined by the speed at which the technician pulls the hand proofer across the substrate, and the impression pressure the technician applies to the hand proofer while moving it across the substrate. Thus, the speed and impression is totally dependent on the manual skill of the flexographic ink technician, while the only variable not controlled by the technician is the pressure between the ink roller and transfer roller of the manual proofer tool.

U.S. Pat. No. 6,814,001 describes an ink proofer designed to overcome the problems associated with conventional manual proofer tools by generating consistent and reliable ink draws using a hand-held proofer tool retained in a movable mounting assembly. A variable pressure system is coupled to the mounting assembly to move the proofer tool into a contact position with a cylindrical drum. The transfer roller of the proofer tool then transfers ink to a substrate inserted between the drum and the transfer roller of the proofer tool when a drive motor for the drum is engaged.

While the ink proofer described in U.S. Pat. No. 6,814,001 produces more reliable, consistent and repeatable ink proof on a substrate, the wet ink disposed on the proof substrate poses a problem and the quality of the proofs produced by the ink proofer can be materially affected until such time as the ink has dried.

Accordingly, there is a need for an ink proofer arrangement that permits a flexographic ink technician to more efficiently create proofs that addresses the problems of wet ink on a proof. An approach that addresses the aforementioned problems, as well as other related problems, is therefore desirable.

SUMMARY OF THE INVENTION

The ink proofer of the present invention substantially meets the aforementioned needs of the industry. According to one aspect of the invention, an ink proofer arrangement includes an ink proofer tool, a cylindrical drum roller, a drive motor adapted to rotate the roller and a first movable mounting assembly to retain the ink proofer tool adjacent to and in a non-contact position with the roller. A first variable pressure assembly coupled to the mounting assembly moves the ink proofer tool between a contact with pressure position and a non-contact position with the roller. The ink proofer arrangement also includes a UV light source positioned downstream of the ink proofer tool as part of the ink proofer arrangement to more quickly and uniformly dry the inks on the proof substrate. In one embodiment, the UV light source is pivotable to permit access to the proof substrate. In another embodiment, the UV light source is selectively positionable at different distances from the ink proofer tool so as to provide for adjustability of a dwell time for the proof.

The above summary of the present invention is not intended to describe each illustrated embodiment or every implementation of the present invention. The figures in the detailed description that follow more particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1:
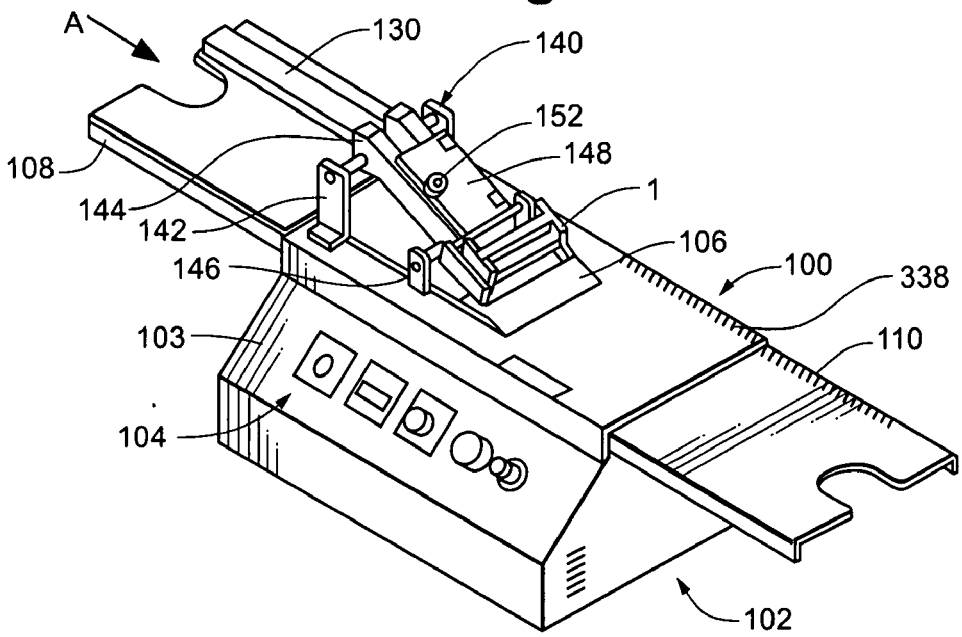
FIG. 1 is a perspective view of an embodiment of an ink proofer arrangement of the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE DRAWINGS

The present invention is generally directed to an ink proofer arrangement that is adapted to operate with a variety of hand ink proofer devices to provide ink proofs that are reliable and repeatable and that are consistent from one ink proof to another. While the present invention is not necessarily limited to such an application, the invention will be better appreciated using a discussion of example embodiments in such a specific context.

In one example embodiment, an ink proofer arrangement is adapted to be used with an ink proofer tool, the ink proofer tool including an ink transfer roller. The ink proofer arrangement further includes a cylindrical roller and a drive motor adapted to rotate the roller. In addition, a first movable mounting assembly is included that retains the ink proofer tool adjacent to and in a non-contact position with the roller. The proofer arrangement further includes a first variable pressure assembly coupled to the mounting assembly and adapted to move the ink proofer tool into a contact with pressure position with the roller and further adapted to move the ink proofer tool into the non-contact position, wherein the transfer roller is adapted to transfer ink to a substrate that is inserted between the roller and the transfer roll of the ink proofer tool when the drive motor is engaged.

In another related embodiment, an ink proofer arrangement is adapted to be used with an ink proofer tool, the ink proofer tool including an ink transfer roller, a cylindrical roller and a drive motor adapted to rotate the roller. In addition, a mounting assembly is adapted to retain the ink proofer tool adjacent to and in a non-contact position with the roller. The ink proofer arrangement also includes a movable support assembly adapted to support the roller and a first variable pressure assembly coupled to the movable support assembly and adapted to move the roller into a contact with pressure position with the ink proofer and to move the roller into a non-contact position with the ink proofer tool, wherein the ink transfer roller is adapted to transfer ink to a substrate that is inserted between the roller and the transfer roll of the ink proofer tool when the drive motor is engaged.

Referring now to the Figures, FIG. 1 illustrates a perspective view of an embodiment of an ink proofer arrangement 100 of the present invention. In this example embodiment, ink proofer arrangement 100 includes a base unit 102 that supports a hand ink proofer tool 1 and is configured to move a substrate (not shown) through the unit via a cylindrical drum roller 106 to produce an ink proof. Base unit 102 includes a control panel 104 and a pair of support plates 110 and 108 (optional, depending on the length of the substrate) that can be simply clipped on when desired. In another embodiment, support plates 110 and 108 include a pair of guide rails for guiding a sheet of paper or other substrate through base unit 102. The combination of base unit 102 and ink proofer tool 1, according to the teachings of the present invention, facilitate generating ink proof samples irrespective of the manual ink drawing skills of the operator. Further, proofer arrangement 100 of the present invention is advantageously not necessarily limited to ink proofer tools of the type described hereinafter.

Proofer arrangement 100 further includes a housing 103, which in this example embodiment is made to be spill proof such that the proofer arrangement can be washed down easily without damaging any of the internal components. Mounted on housing 103 are a number of control switches and displays that comprise control panel 104. Protruding from the upper surface of housing 103 is a rubber cylindrical drum roller 106 that is driven by a drive motor (for moving a substrate in the direction of arrow A). Proofer arrangement 100 is also configurable to have roller 106 rotate in the opposite direction so that the arrangement is bi-directional with respect to movement of the substrate. Base unit 102 further includes support plates 108, 110 which can be mounted optionally on base unit 102 when the substrate is of considerable length.

Manual ink proofer tool 1 is supported on base unit 102 via an ink proofer tool support arrangement 140. In its simplest form, proofer tool support arrangement 140 is simply an angled support structure that is affixed to the top of base unit 102 for supporting ink proofer tool 1 at a predetermined angle. In this particular embodiment, tool support arrangement 140 is designed to be movable in the vertical direction so as to raise and lower ink proofer tool 1 vertically up and away from cylindrical drum roller 106 or vertically down and in contact with cylindrical drum roller 106. Tool support arrangement 140 includes a vertical fix support bracket 142 that is coupled to a proofer tool support plate 144 that is in turn coupled to a proofer tool movement mechanism 146 which moves vertically up and down through the surface of the base unit 102 thereby moving ink proofer tool 1 as desired. Ink proofer tool 1 is secured to support arrangement 140 via a proofer tool secure plate 148 and a fastening screw 152.

Figure 2A:
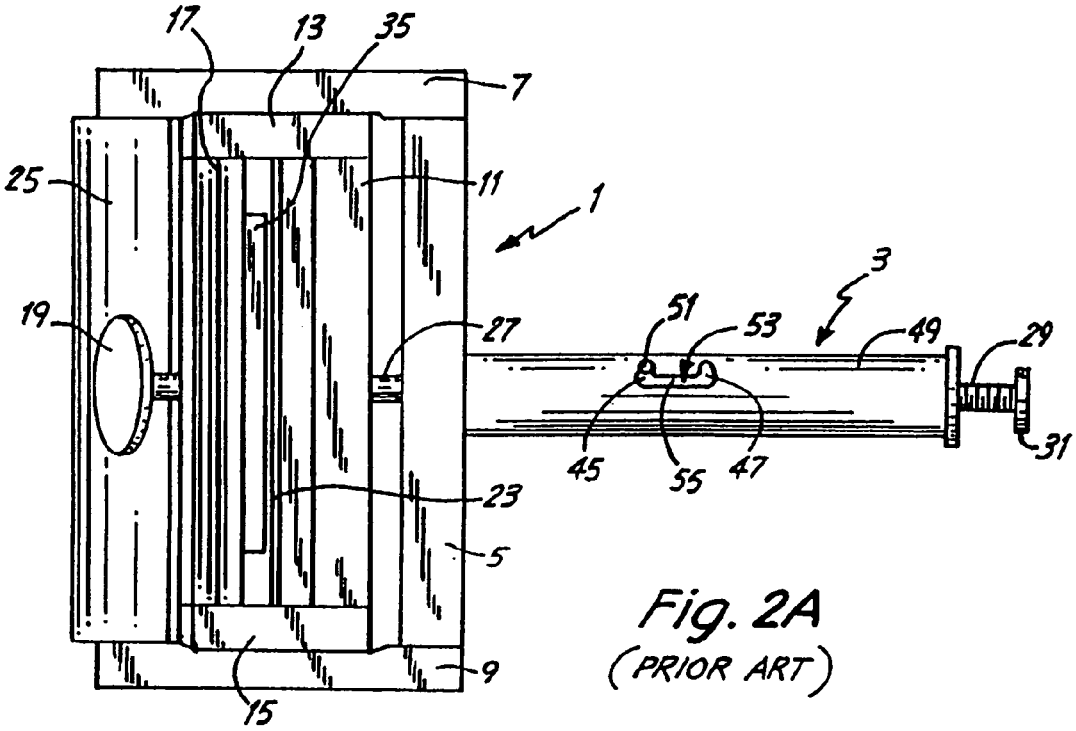
Fig. 2A (PRIOR ART)
FIG. 2A is a top view of an ink proofer tool that is mountable on one embodiment of the ink proofer arrangement of the present invention.
Figure 2B:
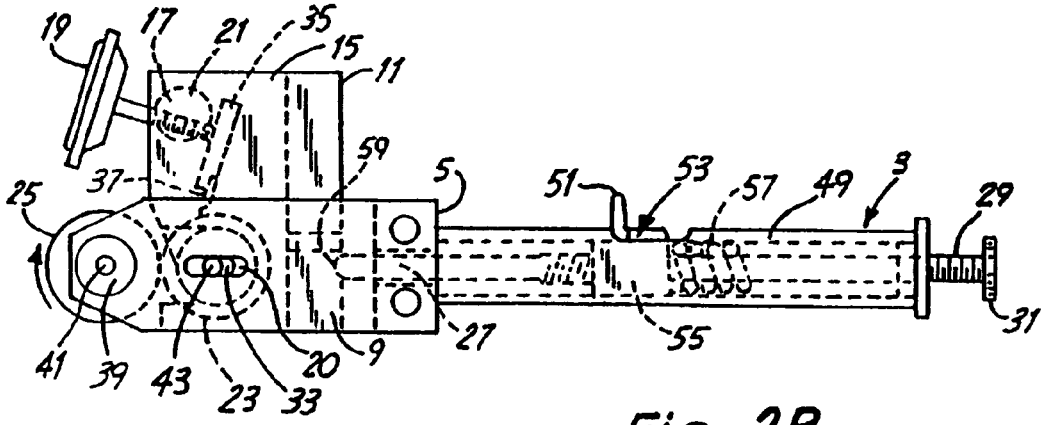
Fig. 2B (PRIOR ART)
FIG. 2B is a side view of an ink proofer tool of FIG. 2A.

FIGS. 2A and 2B illustrate top and side views, respectively, of ink proofer tool 1 that is mountable on one embodiment of the ink proofer arrangement 100. In particular, tool 1 includes a handle 3, a base frame 5 and sideframes 7 and 9. Base frame 5 has a hole that accommodates pressure rod 27 along with a threading for attaching handle 3 to the base frame. Sideframes 7 and 9 extend as shown and are adapted to receive a subframe and a transfer roll. Connected to sideframes 7 and 9 of base frame 5 is an anilox roll-nesting subframe 11. Subframe 11 has sides 13 and 15, as well as a blade adjustment means holder 17. Additionally, subframe sides 13 and 15 could be grooved and sideframes 7 and 9 could be likewise grooved in a complementary fashion so that they fit into one another. There is an indentation 59 which receives pressure rod 27 and this also helps maintain proper alignment of the subframe 11 within base frame sideframes 7 and 9.

Anilox roll 23 is located within nesting subframe 11 and its pins such as anilox roll pin 43 extends from anilox roll 23 to extend at least partially into or even through an elongated set of orifices, one on each of sideframes 7 and 9, illustrated by elongated orifice 20 shown in FIG. 2B. Anilox roll 23 is pressed against transfer roll 25 and pressure rod 27 maintains the pressure against nesting subframe 11 so that it forces anilox roll 23 against transfer roll 25 at a predetermined pressure resulting from rotation of pressure rod adjustment means 29, by rotating gripping dial 31, for example, clockwise to tighten and counterclockwise to un-tighten. Pressure rod adjustment means 29 is threaded and fits into pressure rod release means collar 55. Thus, the collar 55 is held in a position as shown so that as pressure rod adjustment means 29, when it is rotated downwardly or upwardly and is directly connected to pressure rod 27, ending in indentation 59 of subframe 11, causes the subframe 11 and anilox roll 23 to move accordingly.

Connected to subframe blade adjustment means holder 17 is blade adjustment means 19, in this case, a rotatable dial which includes a screw 21 which is threaded and passes through a screw tapped orifice in holder 17. At the end of screw 21 is blade holder 35 and blade 37 set up as a follower-type doctor blade so that ink may be located behind the doctor blade and the blade will both act as a wiping blade and as a distributing fountain. By rotation of blade adjustment means 19, for example clockwise to go upwardly away from subframe 11 and counterclockwise to go downwardly toward it, blade 37 may be adjusted against the surface of anilox roll 23 accordingly. In this device 1, the anilox roll 23 has bearings such as bearings 33 so as to facilitate its ease of rolling. Thus, the bearings are adapted to fit over the anilox roll pins such as pin 43 and are contained within a washer-type fitting which nests within the subframe 11. The sideframes 7 and 9 each also include a transfer roll pin holding insert such as insert 39. This is adapted to receive the transfer roll pins such as pin 41, as shown.

Referring again to handle 3 and hollow member 49, there is a pressure rod release means 53 which includes a cut-out as shown, pressure rod release means collar 55 and pressure rod release means lever 51, as well as spring 57. Spring 57 is strategically located and held in place so as to push collar 55 and therefore pressure rod adjustment means 29 and pressure rod 27 against the subframe 11. When pressure rod release means lever 51 is located in its first position, shown as first position 45, the pressure rod 27 is engaged with subframe 11 and, therefore under pressure. The pressure rod release means lever 51 may be pushed clockwise then away from the subframe 11 and then counterclockwise (in other words, in a "U" direction), so as to move from a first position 45 to second position 47. In second position 47, pressure rod 27 is totally disengaged from subframe 11 and subframe 11 may be easily removed or rotated for cleaning of the anilox roll 23 without affecting, altering or changing in any way the setting and therefore the pressure relationship which will be re-achieved when pressure rod release means lever 51 is moved from second position 47 back to first position 45.

Figure 5:
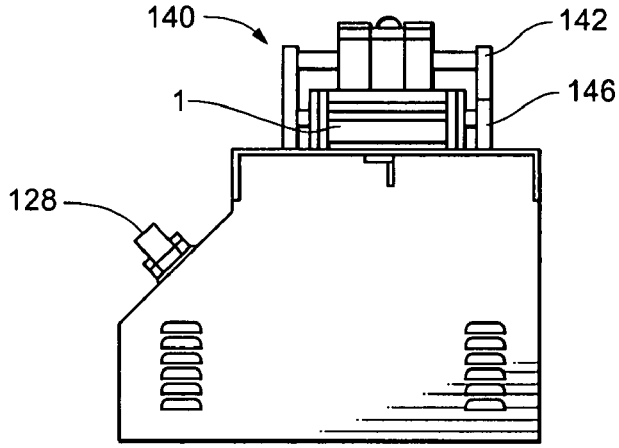
FIG. 5 is an end elevational view of the ink proofer with certain components depicted in phantom.
Figure 3:
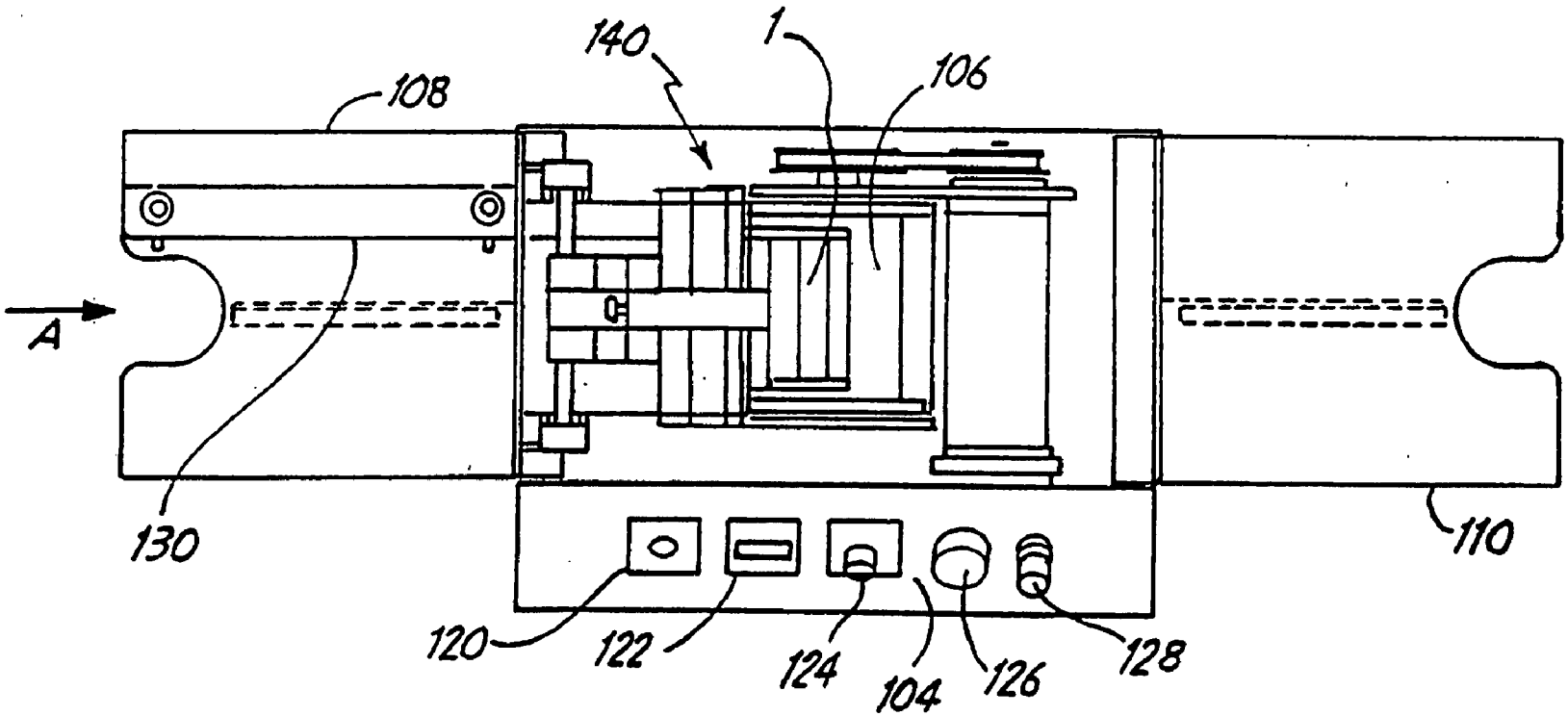
FIG. 3 is a top view of the ink proofer arrangement with certain components being depicted in phantom.
Figure 4:
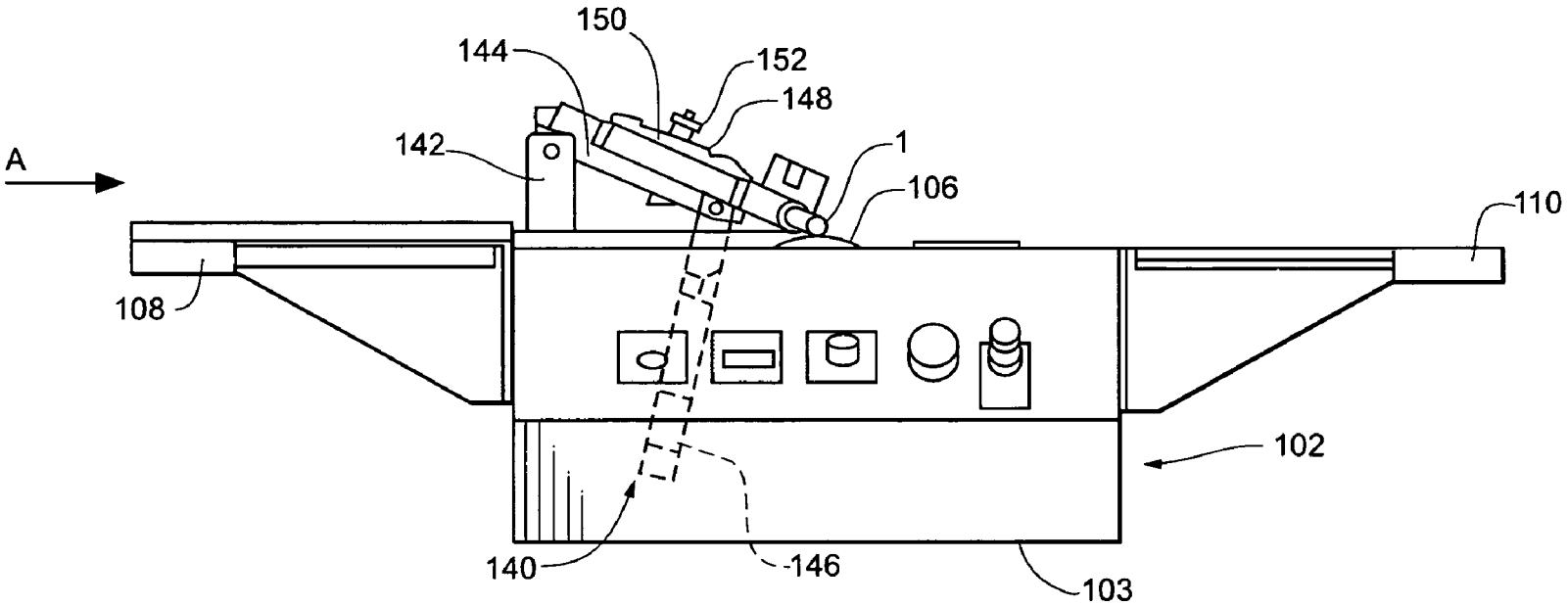
FIG. 4 is a side elevational view of the ink proofer with certain components being depicted in phantom.

Referring now to FIGS. 3-5, a preferred embodiment of proofer arrangement 100 of the present invention is shown. Base unit 102 includes a main housing 103 in which a rubber covered cylindrical drum roller 106 is mounted that is driven by a drive motor (not shown) within base unit 102. In a preferred embodiment thereof, the drive roll comprises a cylindrical metallic roll having an elastomer covering on the cylindrical surface thereof.

As illustrated in FIG. 3 control panel 104 includes in this example embodiment an on/off switch 120 which can be substituted with a push button so as to control the proofer manually as the substrate is fed through the proofer arrangement 100. Control panel 104 also includes a digital speed display 122 as well as a speed control button 124 for setting the speed from anywhere to 200-900 FPM or 400-1500 FPM (feet per minute). The pressure gauge 126 is also included which provides feedback to the user when using the air regulator 128 to control the pressure of the roller 106 against the rollers of the ink proofer tool 1. Base unit 102 further includes substrate guide 130 for insuring that the substrate is fed evenly through proofer arrangement 100.

Referring to FIG. 4, in this example embodiment proofer arrangement 100 is configured to lift ink proofer tool 1 above roller 106 to provide the additional feature of keeping the roller 106 clean until the substrate is fed through arrangement 100 and proofer tool 1 is then placed on the substrate. In this example embodiment, proofer tool mechanism 146 senses as the substrate is about to terminate so as to push up the proofer tool 1, thereby preventing ink from flowing onto cylindrical drum roller 106. In a related embodiment, where a proofer tool movement mechanism 146 is not included, the operator can manually stop proofer arrangement 100 before the substrate comes to the end.

Referring briefly to FIG. 5, there is illustrated a side view of proofer arrangement 100 with the ink proofer tool 1 resting on the surface of roller 106. Ink proofer tool 1 is also resting on ink proofer tool support arrangement 140 located over base unit 102.

Figure 6A:
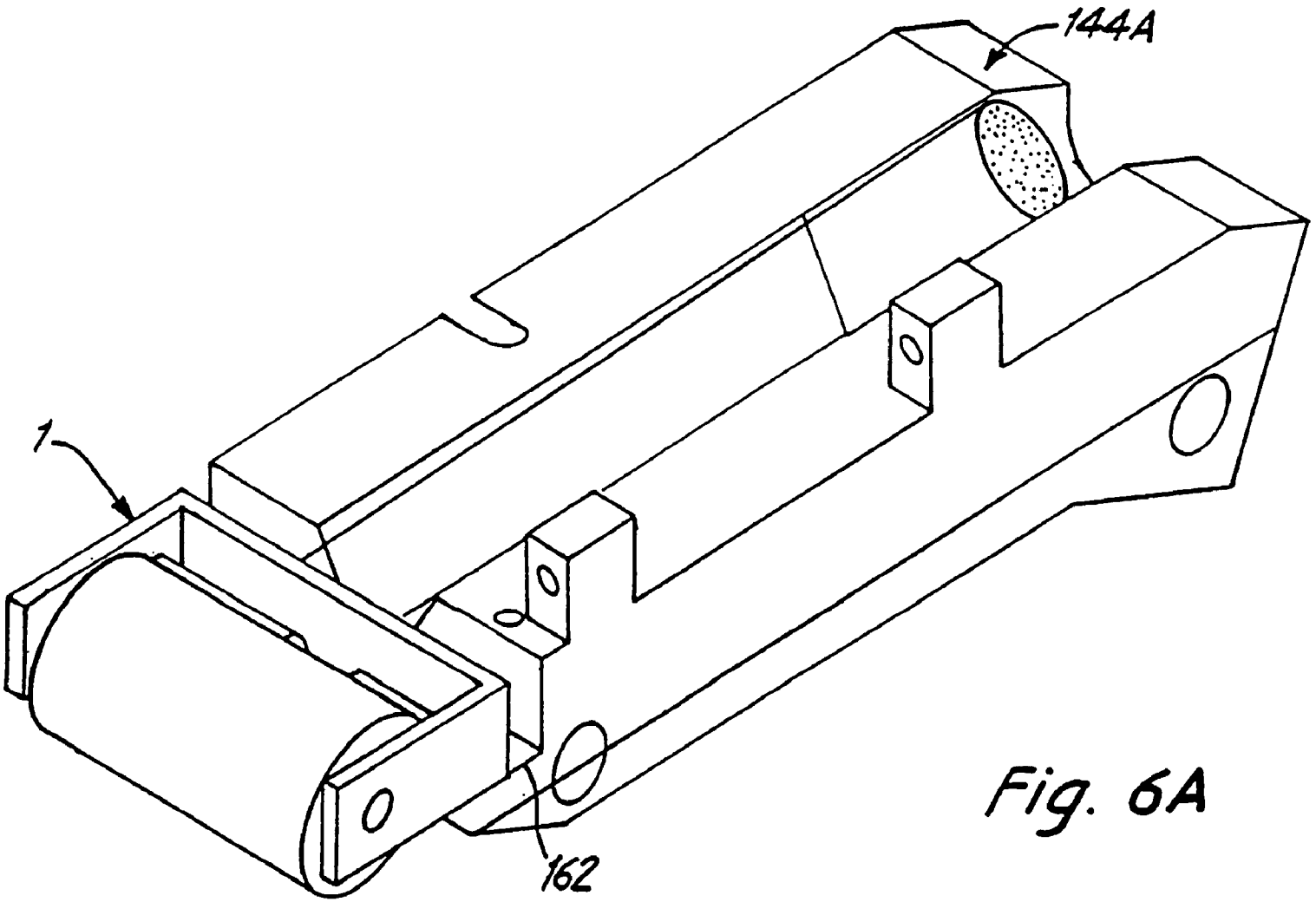
FIG. 6A is a universal ink proofer holder with an ink proofer mounted therein.

Referring now to FIG. 6A, there is illustrated ink proofer tool 1 that is set within a universal proofer holder 144A according to the present invention. The ink proofer is held within holder 144A via a notch 162.

Figure 6B:
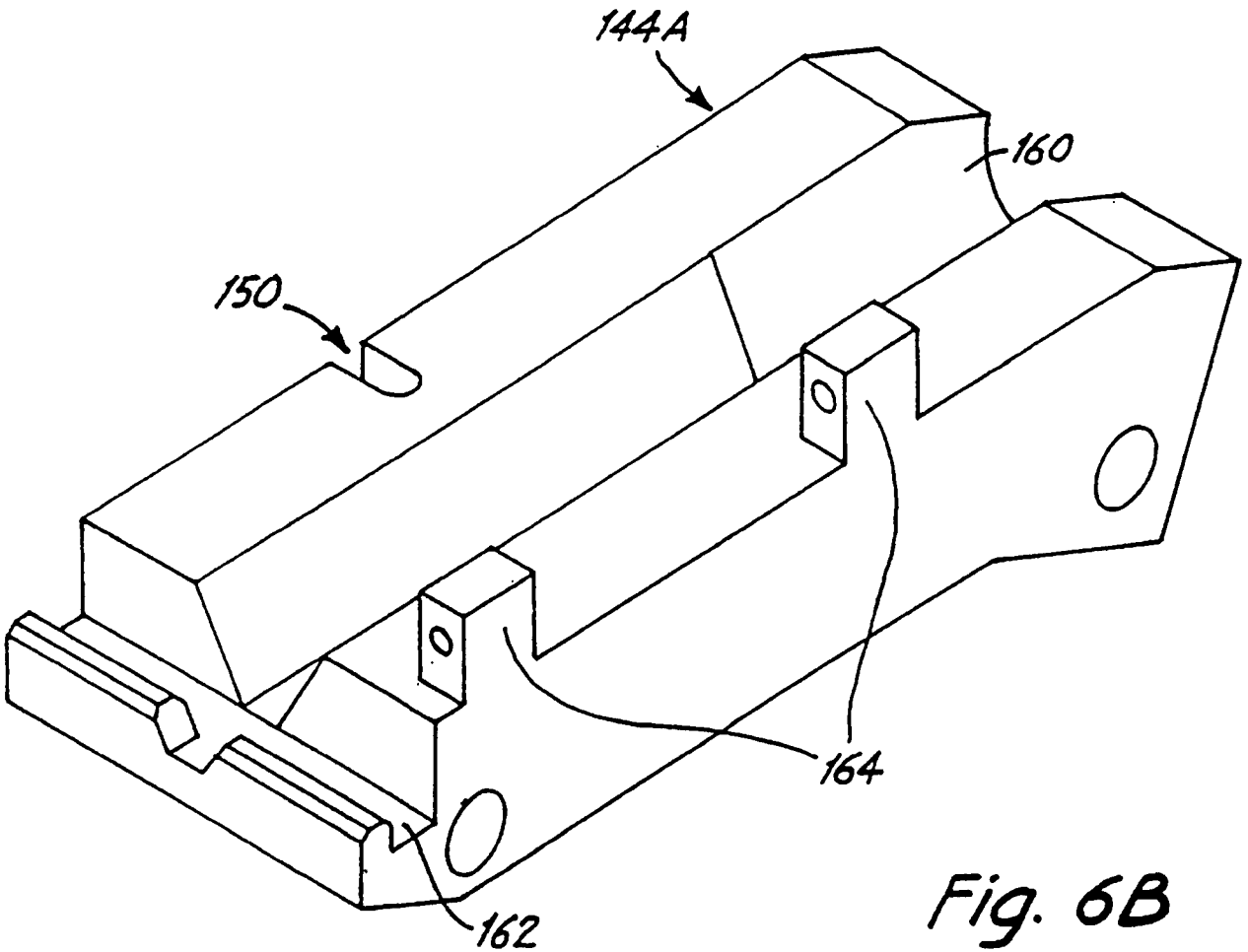
FIG. 6B is one embodiment of the universal proofer holder of FIG. 6A in accordance with the present invention.

FIG. 6B illustrates the universal proofer holder without ink proofer tool 1. Universal proofer holder 144A includes a channel 160, which accommodates the handle of the ink proofer, and a notch 162 that aids in maintaining the proofer in universal proofer holder 144A. Universal holder 144A further includes a set of hinges 164 that engage a cover plate that maintains the ink proofer tool in the universal holder. Holder 144A further includes an aperture 150 for accommodating a fastening screw 152 that maintains the cover plate over universal holder 144A.

Figure 6C:
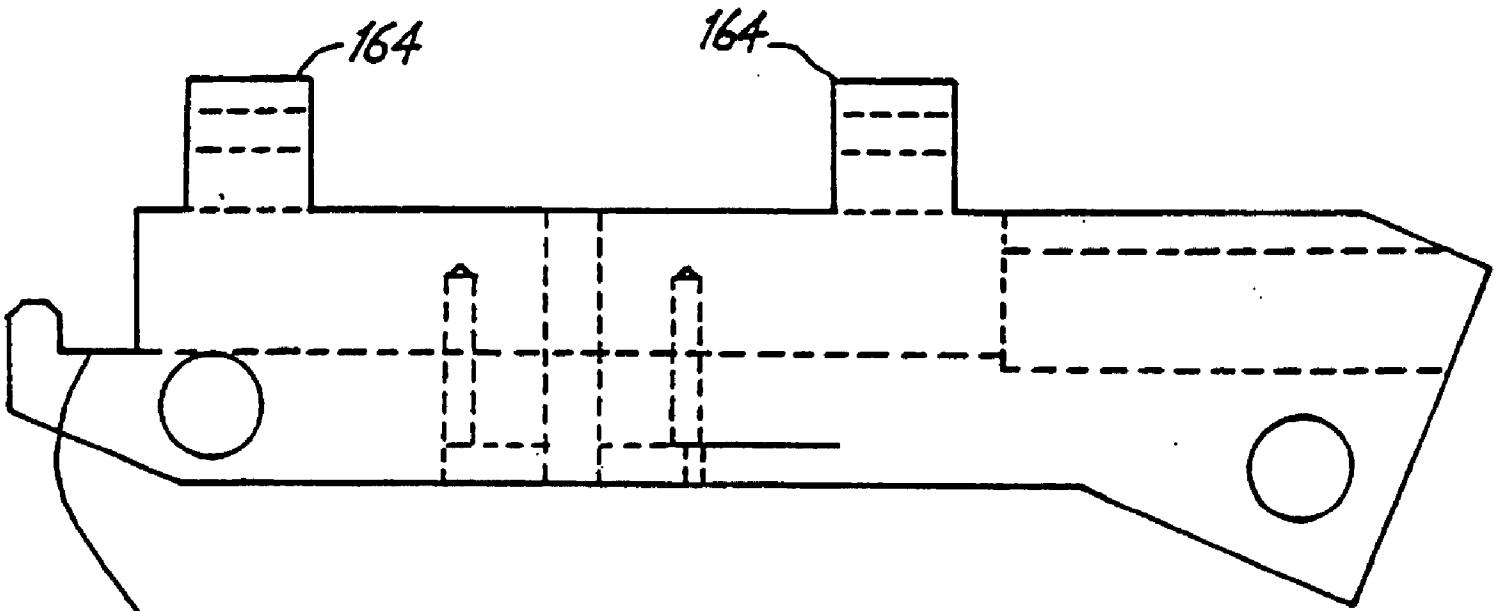
FIG. 6C is a side view of the universal proofer holder illustrated in FIG. 6B.

FIG. 6C illustrates a side view of universal holder 144A which includes notch 162 and hinges 164. In this embodiment, universal holder 144A is made from a polymer (i.e., plastic) but can also be made from metal or any other material that can be formed to include a channel 160 and notch 162. Channel 160, in this example embodiment, is formed in a V-shaped groove; however, it can be formed in a square groove or circular groove depending on the proofer handle configuration.

Figure 7:
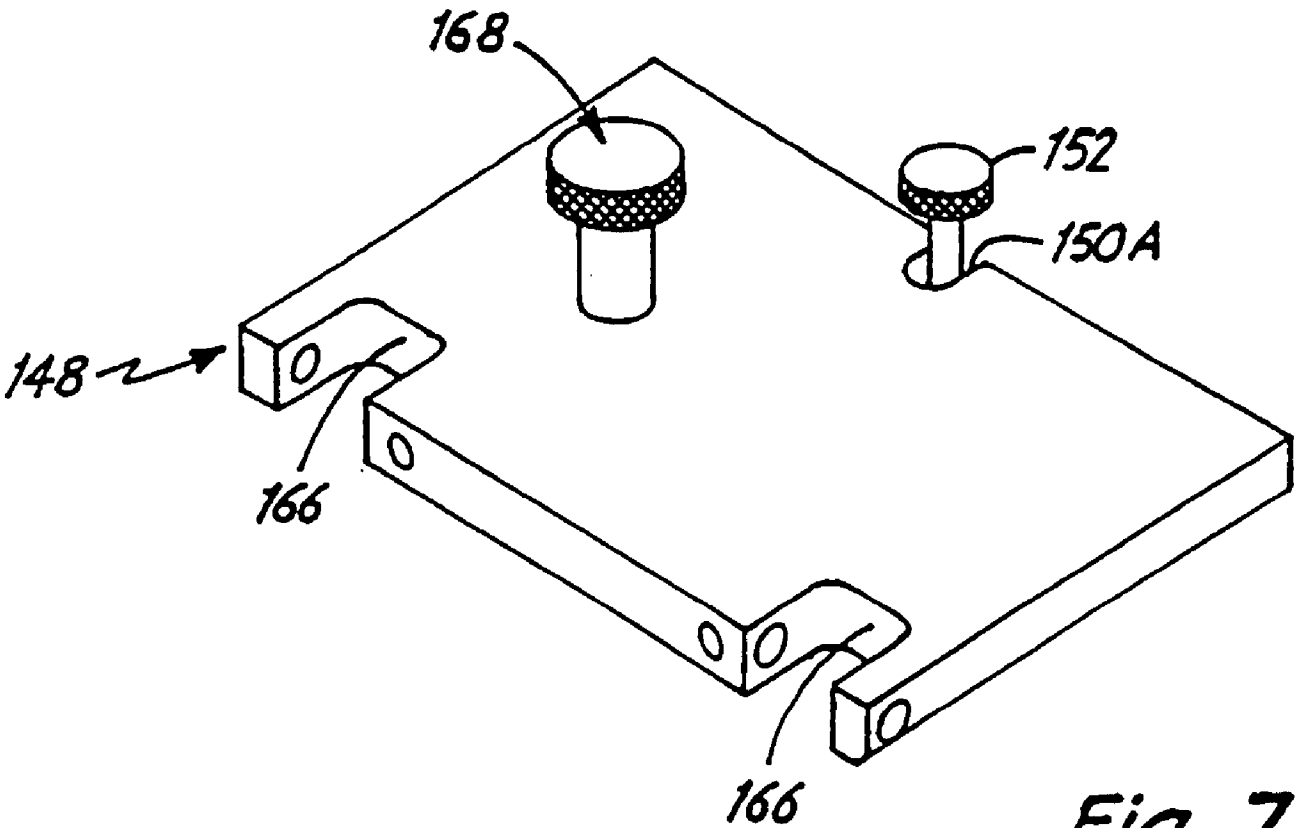
FIG. 7 is a perspective view of one embodiment of the cover plate for the universal proofer holder.

FIG. 7 illustrates one example embodiment of a cover plate 148 that includes hinge apertures 166 that engage hinges 164 of universal holder 144A. Cover plate 148 further includes an aperture 150*a* that corresponds with 150 on universal holder 144A for accommodating fastening screw 152. This example embodiment of cover plate 148 further includes an adjustment knob 168 for adding downward pressure to an ink proofer handle located in channel 160 to secure the proofer holder in the channel. Adjustment knob 168 provides the advantage of allowing universal holder 144A to accommodate the proofer handles of various diameters while still allowing some angular movement in the proofer handle during the ink draw down process.

Referring now to FIGS. 8A-8C and 10, there is illustrated another example embodiment of proofer arrangement 200 that is configured to automatically lift ink proofer tool 1 (default position) above a cylindrical drum roller 218 when a start button 226 is disengaged. Proofer arrangement 200 includes a pressure gauge 202 and a pressure adjust 204 which allows the user to adjust the pressure of the hand proofer tool on the substrate used to create the ink proof. Proofer arrangement 200 further includes a speed adjust 206 and a digital speed read-out tool 208 that allows the user to adjust the speed of the roller that moves the substrate under the ink proofer tool 1. A unibody frame 210 that accommodates universal holder 144A and ink proofer tool 1 is attached to a pivot point 212 of arrangement 200. The other end of unibody frame 210 is attached to an actuation/pressure cylinder 214, which operates to move unibody frame vertically, thereby moving the proofer handle up when proofer arrangement 200 is actuated by start button 226. Proofer arrangement 200 further includes a proofer tool support assembly that is comprised of universal holder 144A, a cover plate 148 and hand proofer tool 1. Coated cylindrical drum roller 218 is driven by a belt and pulley drive 220 (via a cog belt) that is further driven by an air motor 222 located adjacent the coated roller. The speed of motor 222 is controlled by air motor speed control 224 via the exhaust of motor 222.

Figure 8A:
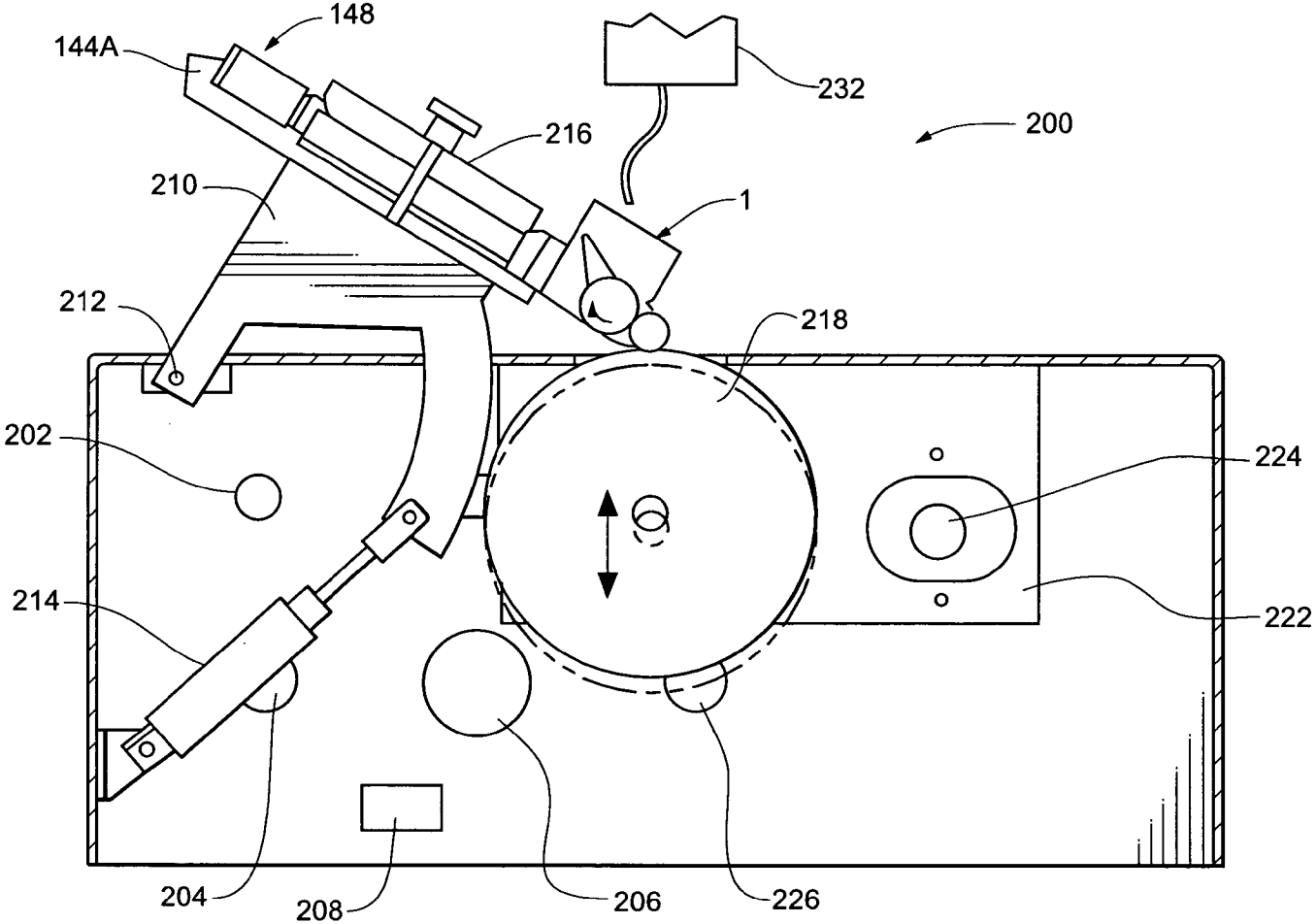
FIG. 8A is a side view of another embodiment of an ink proofer arrangement of the present invention.
Figure 8B:
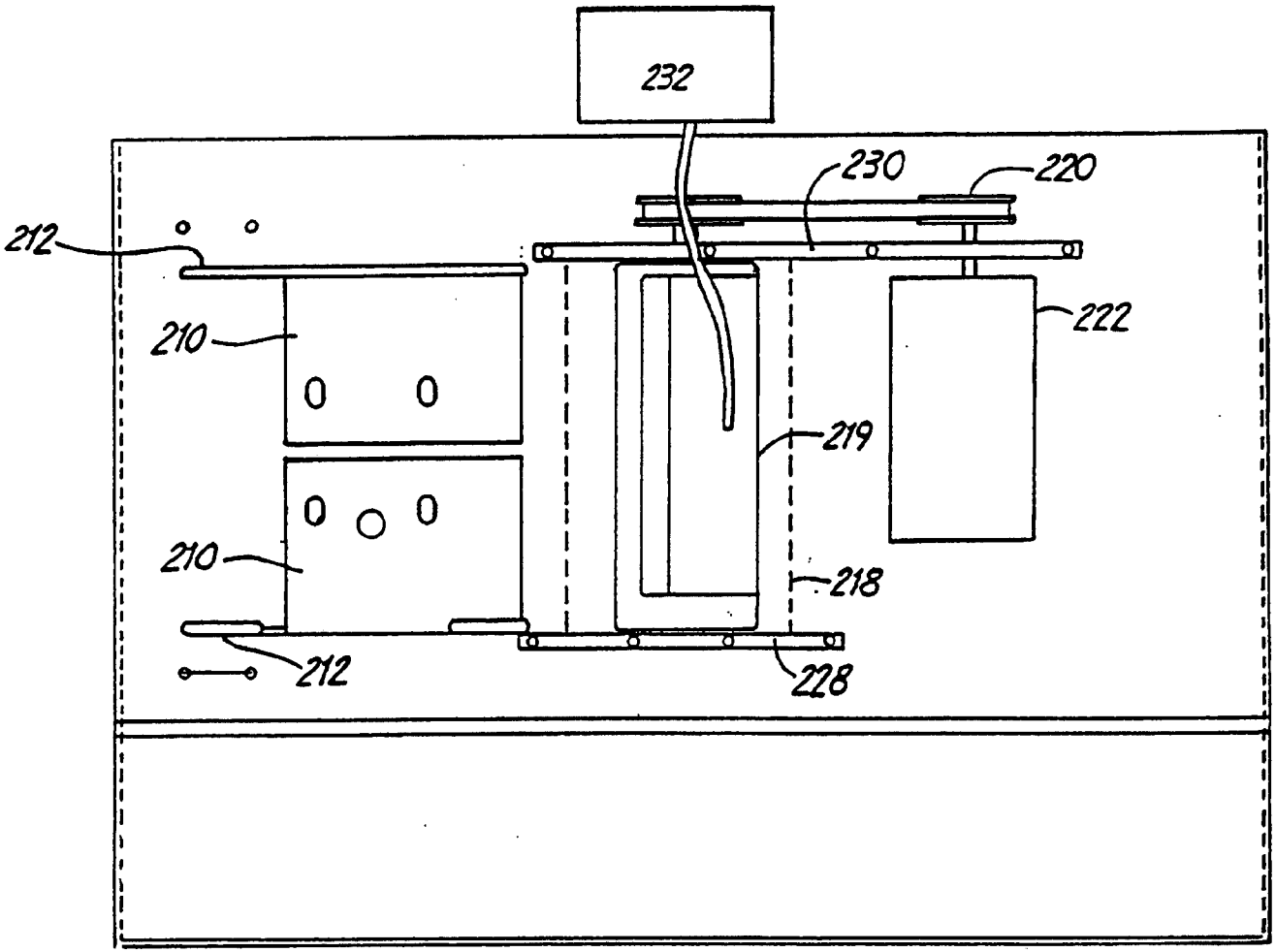
FIG. 8B is the top view of the ink proofer arrangement illustrated in FIG. 8A.

FIG. 8B illustrates a top view of proofer arrangement 200 that includes unibody 210 that pivots around pivot points 212. Cylindrical drum roller 218 is partially shown in visible lines as part of it protrudes through a roller window 219, which protrudes through the top plate of proofer arrangement 200. Cylindrical drum roller 218 is supported by roller support bracket 228 and roller and motor support bracket 230. Motor 222 drives pulley drive 220 which in turn drives roller 218 thereby moving the substrate across the surface of proofer arrangement 200. In this example embodiment, an ink well 232 with a tube can be adapted to provide a continuous supply of ink to the proofer tool disposed above the substrate and roller 218.

Figure 8C:
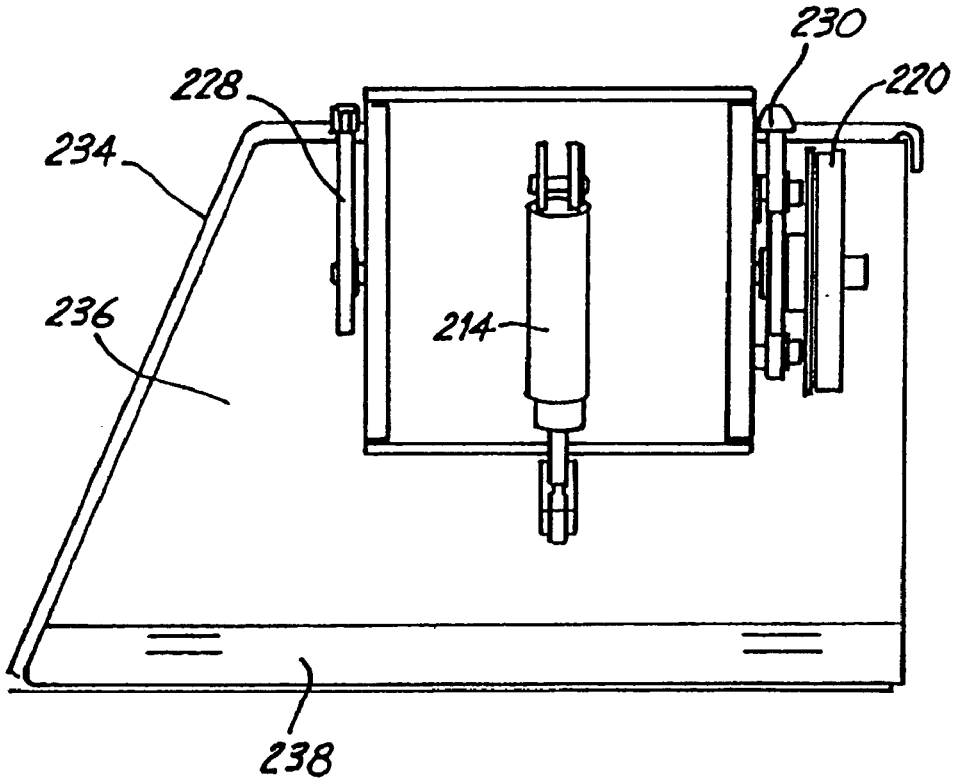
FIG. 8C is a side view of the ink proofer arrangement illustrated in FIG. 8A.

FIG. 8C illustrates a side view of proofer arrangement 200 including pulley drive 220 and brackets 228 and 230. In addition, the housing of proofer arrangement 200 includes a spill proof top 234 with spill proof sides and back 236 as well as an open vent bottom 238. With open vent bottom 238 proofer arrangements 100 and 200 can be easily washed down and cleaned because the unit can drain the fluids through the bottom vents and can air dry quickly to facilitate its use in industrial environments.

Figure 9:
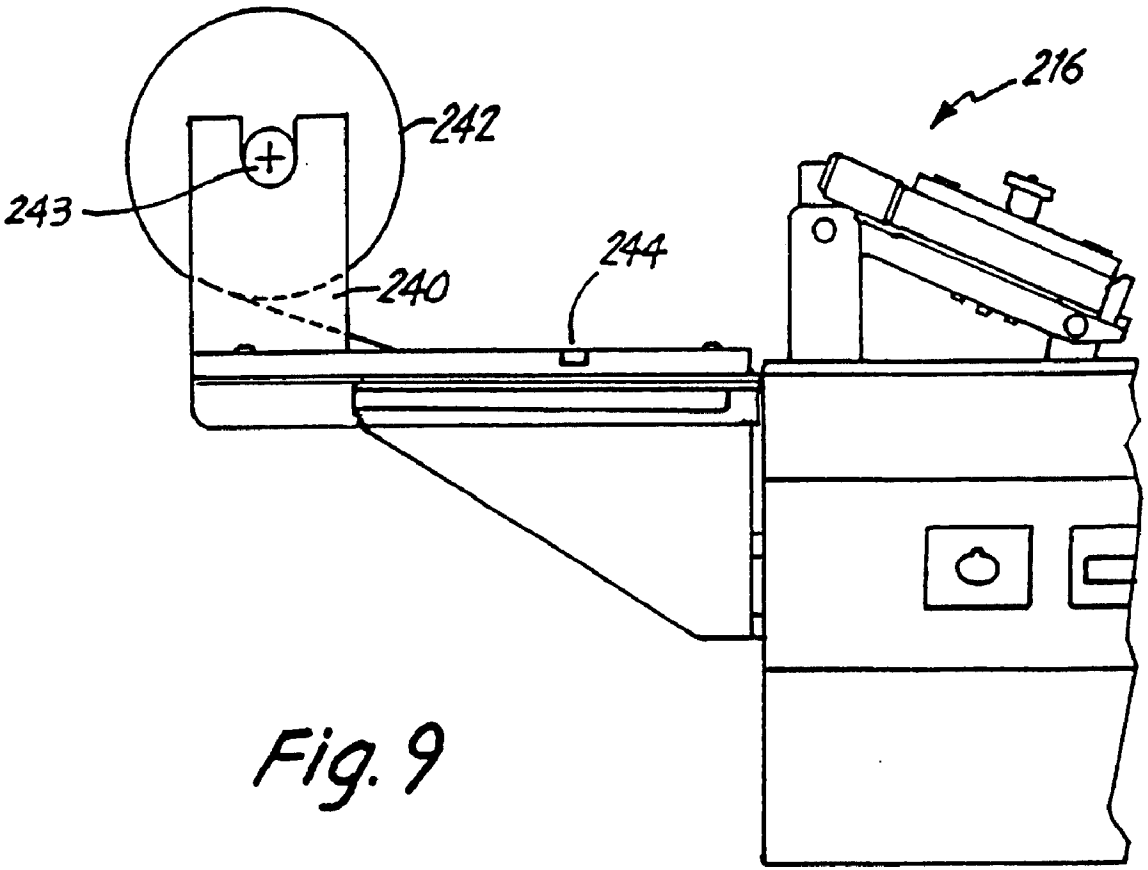
FIG. 9 is a substrate roll attachment for the ink proofer arrangement of the present invention.

FIG. 9 illustrates a substrate roll support 240 that can be retroactively attached to any of the proofer arrangements disclosed herein. Substrate roll support 240 includes at least one bracket for mounting substrate roll 242 through a rod 243 that helps to roll the substrate past a cutting groove 244 and under proofer tool support assembly 216. This embodiment provides the user with ink proof samples of various sizes depending on the desired application. The substrate can also be configured with or to include perforations in order to simplify the formation of ink proofs without having to provide a paper or substrate cutter to the proofer arrangement.

Figure 10:
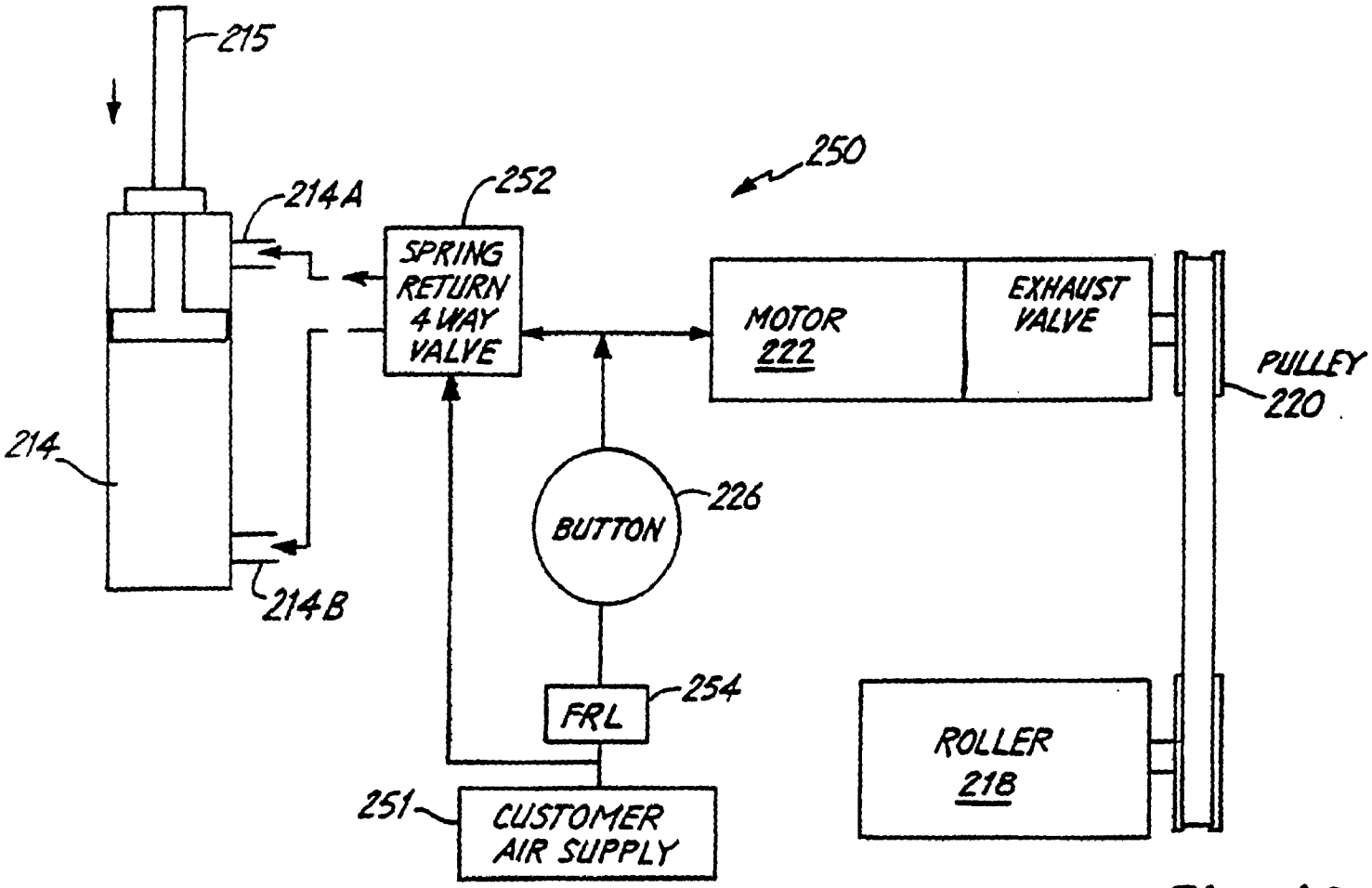
FIGS. 10-10A are schematic drawings of actuation of the pressure cylinder controlling the universal proofer holder of the present invention.

FIG. 10 illustrates a schematic of a hand proofer pressure actuation system 250 according to the teachings of the present invention. In particular, system 250 assists in moving proofer tool support assembly 216 vertically with respect to cylindrical drum roller 218. System 250 receives air from the customer's plant via air supply 251 which is thereafter provided to a spring return four-way valve 252 and to a regulator lubricator device 254 before it is connected to start button 226. When start button 226 is actuated air is provided to both motor 222 and to valve 252. Motor 222 in turn drives pulley drive 220 which drives cylindrical drum roller 218. The air supplied by pressing button 226 in turn actuates valve 252 such that air is supplied to either upper port 214A of pressure cylinder 214 or lower port 214B which raises or lowers the plunger 215 within cylinder 214. Moving plunger within pressure cylinder 214 in turn moves unit body 210 vertically with respect to roller 218. When button 226 is released, cylinder 214 returns to its default position, which is in the up position away from cylindrical drum roller 218. System 250 is configured such that when button 226 is actuated, roller 218 begins to rotate as unibody 210 drops down to engage the substrate and roller 218. Once the button 226 is released cylindrical drum roller 218 stops rolling because the air supply to motor 222 has been cut off and plunger 215 of cylinder 214 returns to its extended position thereby raising the unibody frame 210.

In an alternative embodiment, system 250 can be configured to add a pressure cylinder to roller arrangement such that the roller is moved vertically into window 219 when button 226 is depressed and moves away from window 219 when button 226 is released. In yet another embodiment as schematically depicted by the arrows in FIG. 8A, system 250 is configurable to include two pressure cylinders such that both unibody 210 with ink proofer 1 moves in a downward direction towards cylindrical drum roller 218 while roller 218 moves in an upward direction so as to engage the substrate at the surface of the proofer arrangement. With the appropriate controls the pressure of ink proofer 1 can be adjusted online depending on the types of proofs that are desired. For instance, as the proof is being developed different pressures can be applied along the length of the ink proof to determine which is the best pressure for placing the ink on the substrate. One of the advantages of the present invention is that pressure of the ink proofer can be varied from ink proofer arrangement 200 and need not be controlled from ink proofer tool 1. In addition, the speed can also be controlled from proofer arrangement 200 as pressure is simultaneously varied without interfering with ink proofer tool 1. In another embodiment, proofer arrangements 100 and 200 can be retrofitted with end of substrate sensors to disengage the hand proofer tool and prevent ink from flowing over cylindrical drum roller 218 and onto the top of the proofer arrangement. In one example embodiment, an air logic sensor can be retrofitted on the rear flange of proofer arrangement 100, which then signals spring valve 252 to raise pressure cylinder 214 and lift the proofer away from the roller. In another related embodiment, a photo light sensor can also be used to detect the end of the substrate thereby actuating valve 252 while button 226 remains depressed.

Proofer arrangement 100 is also configured to be self-equalizing thereby providing a wrist action to allow the rolls on the ink proofer tool 1 and cylindrical drum roller 106 to conform to any movement of wobble during the ink proofing process. By using a pneumatic drive mechanism, the concerns that ink technicians have that utilize solvents with low flash points may be alleviated when using the present invention. In a relating embodiment, the drum of roller 106 has a speed sensing device that will read out in feet per minute, which will provide an actual speed read out with control and various speed controls. Proofer arrangement 100 also includes a down pressure gauge to determine how many pounds of pressure are being applied with the ink proofer tool 1.

In this example embodiment, the drive motor is preferably of the air type (½ horse power) but proofer arrangement 100 can also be configured to operate with a clutch drive and clutch brake assembly. In other embodiments, the drive motor can include a DC motor, an electric motor or an AC motor. In this example embodiment, roller 106 is comprised of a natural rubber coating of 70-75 Durometer hardness bonded onto an aluminum roll. Proofer arrangement 100 enables the user of the present invention to achieve or reproduce the same angles of printing encountered during commercial flexographic printing while providing faster proofing speeds as a result of the air motor driven motor.

One example embodiment of the ink proofer arrangement can proof a maximum width of six inches. Further, the proofer will process almost any length of substrate desired. A minimum of 9½ inches of substrate is required. Additional widths may be specified in increments of 2 inches up to a width of 14 inches.

The ink proofer arrangement may also be adjusted for proofing speeds of 50 to 1,500 feet per minute with other ranges being available as desired. The ink proofer includes precision readouts for speed of the substrate and down pressure on the proofer arrangement. In an example embodiment relating to preparing ink samples using non-porous substrates, a proofing speed of about 150 feet per minute is used. In a related embodiment relating to preparing ink samples using porous substrates, a proofing speed of about 50 feet per minute is used.

In one example embodiment, ink proofer arrangement 100 is fully automatic, but manual operations are also contemplated. The substrate is introduced in the left side of the ink proofer arrangement (denoted by arrow A) and by pressing the actuation button, proofer arrangement 100 automatically feeds the substrate through the proofer arrangement and the substrate is discharged on the right side.

FIGS. 11, 11*a*, 12, 12*a* and 12*b* illustrate perspective and side views, respectively, of another embodiment of ink proofer arrangement 300, which includes an ultraviolet (UV) lamp 310 and a mounting bracket 312. UV lamp 310 is held in place by mounting bracket 312 and is mounted such as to allow UV lamp 310 to pivot upwardly and away from the substrate. Such an arrangement allows for cleaning and maintenance of ink proofer arrangement 300. UV lamp 310 is useful for curing ink applied to a substrate that passes below UV lamp 310.

In one embodiment, UV lamp 310 comprises a shutter system, such that when UV lamp 310 is not in use, the shutters are closed. In addition to the shutters being closed, the power provided to UV lamp 310 is reduced to a power saving mode, such that UV lamp 310 is in sleep mode. When the substrate passes a measuring point, a sensor sends a signal that actuates UV lamp 310. The sensor can be a visual sensor, a mechanical sensor, a vacuum sensor, an air logic sensor or the like. The lamps of UV lamp 310 turn to high power as the shutters or louvers (not shown) of UV lamp 310 open and allow UV light to pass through the open shutters and irradiate the substrate below. The substrate beneath UV lamp 310 is exposed to ultra-violet light and the ink on the surface of the substrate is allowed to cure. When the end of the substrate passes the sensor, the sensor sends another signal to UV lamp 310 indicating that the end of the substrate is passing beneath UV lamp 310, and that the lamps of UV lamp 310 can be turned to low power or sleep mode. Those skilled in the art will understand that other types of UV lamp arrangements can be used with the ink proofer arrangement 300 and are contemplated.

As noted above, UV lamp 310 is held in place on the ink proofer housing 102 by mounting bracket 312. Mounting bracket 312 allows UV lamp 310 to pivot upwardly and away from the substrate. In one embodiment, mounting bracket 312 is affixed directly to the side of ink proofer housing 103. In another embodiment, mounting bracket 312 is attached to the ink proofer housing 103 by way of at least one rail 330, the rail 330 extending horizontally along the side of the ink proofer housing 103. In another embodiment, mounting bracket 312 is attached to the ink proofer housing 103 by way of a two rail 330 system, the rails 330 parallel to each other and extending horizontally along the side of ink proofer housing 103.

Mounting bracket 312 is slidably attached to a rail 330, wherein at least one bearing 332 allows mounting bracket 312 to travel along the rail 330. Since UV lamp 310 is attached to mounting bracket 312, the two travel horizontally as a unit on rail 330, UV lamp 310 above top surface 334 of ink proofer housing 103. Typically, UV lamp 310 travels between the intersection of transfer roller 326 of the proofer tool and rubber cylindrical drum roller 106, otherwise known as the nip, and the end of ink proofer housing 103 distal the universal proofer holder 144, 144A or 144B. The rails 330 may extend beyond the ink proofer housing 103. Hence, the rails 330 may extend underneath support plate 110 if plate 110 is attached to the base unit 102. In turn, UV lamp 310 may be extended beyond the end of ink proofer housing 103.

The ability to vary the position of UV lamp 310 relative to the nip allows for variation of the ink wicking dwell time of the substrate relative to UV lamp 310. The ink wicking dwell time is the amount of time available for the ink to wick into the substrate after application and before being subjected to UV light. The ink wicking dwell time is affected by a number of factors, including the distance of the UV light source from the nip, and the speed at which the substrate is moving relative to the UV light source. The dwell time can be increased, for example, by increasing the distance of UV lamp 310 from the nip. The increased dwell time provides the ink more time to wick into the substrate. Conversely, if additional dwell time is not needed, due to a combination of, for example, line speed, substrate and ink, then UV lamp 310 can be positioned closer to the nip. Typically, a shorter dwell time does not allow the ink to wick as far into the substrate.

In one embodiment, an adjustable clamp 336 or other adjustable stopping device 336 is affixed to top surface 334 of ink proofer arrangement 300 to secure UV lamp 310 linearly in place. UV lamp 310 is linearly movable to vary ink wicking dwell time. Once the preferred dwell time is established, UV lamp 310 can be secured in place by the stopping device 336. Should the dwell time need to be altered, the stopping device 336 can be moved and fixed to accommodate a new position for UV lamp 310, and thus securing UV lamp 310 in position.

Markings 338 are optionally provided on horizontal top surface 334 of ink proofer housing 103, between the nip and a point proximate the end of ink proofer housing 103. These markings 338 provide a way of recording the position of UV lamp 310 for a particular run, such that the setting could be repeated sometime in the future. The setting can be recorded manually or electronically, for example, by sending a signal to a microprocessor linked to ink proofer arrangement 300. If support plate 110 is optionally mounted on base unit 102, then the markings 338 can continue on the top surface of support plate 110. The markings 338 between the nip and UV lamp 310 on ink proofer arrangement 300 may scale with the markings or distance between the nip and UV lamp(s) on the press. The UV lamp setting can be used as part of the ink proofer arrangement 300 calibration process.

Ink proofer arrangement 300 can be calibrated such that more predictable results may be obtained from a press operation. A wet ink sample, which needs to be matched, is obtained from a press run of the ink and substrate. The press sample is matched by setting variable parameters on ink proofer arrangement 300 until a match of the press run sample is obtained. Ink proofer arrangement 300 variable parameters include the line speed, roller pressure, and the dwell time. Once the variable parameters are set, the parameter settings are recorded and/or fixed, and ink proofer arrangement 300 has been calibrated for that production run. Calibration of ink proofer arrangement 300 may require shifting the position of UV lamp 310, thus altering the dwell time.

Additional colored inks designated to be used in the press run can be run through the calibrated ink proofer arrangement 300 to determine if the color obtained will be acceptable. The proofs provided by ink proofer arrangement 300 provide an indication of the color that will be obtained on the press. Since ink proofer arrangement 300 is calibrated to the press settings, other variable parameters such as ink color can be adjusted to obtain the desired result. The press settings and ink proofer arrangement 310 calibration settings must be maintained; otherwise the initial or calibration run must be redone. For example, if the anilox roller on the press is replaced or the speed of the press is altered, then the ink proofer arrangement must be recalibrated to reflect the new settings.

If, for example, an ink adjustment is required, the experimentation needed to obtain the proper result on the press can first be tried on ink proofer arrangement 300. Once the proper result is obtained on ink proofer arrangement 300, the required adjustment is transferred to the press. On-line press adjustments and ink toning are time-consuming activities, whereas adjustments on ink proofer arrangement 300 can be accomplished more quickly. With ink proofer arrangement 300 results transferable to the press, time and supplies can be saved by making adjustments on ink proofer arrangement 300 instead of directly on the press.

Figure 12:
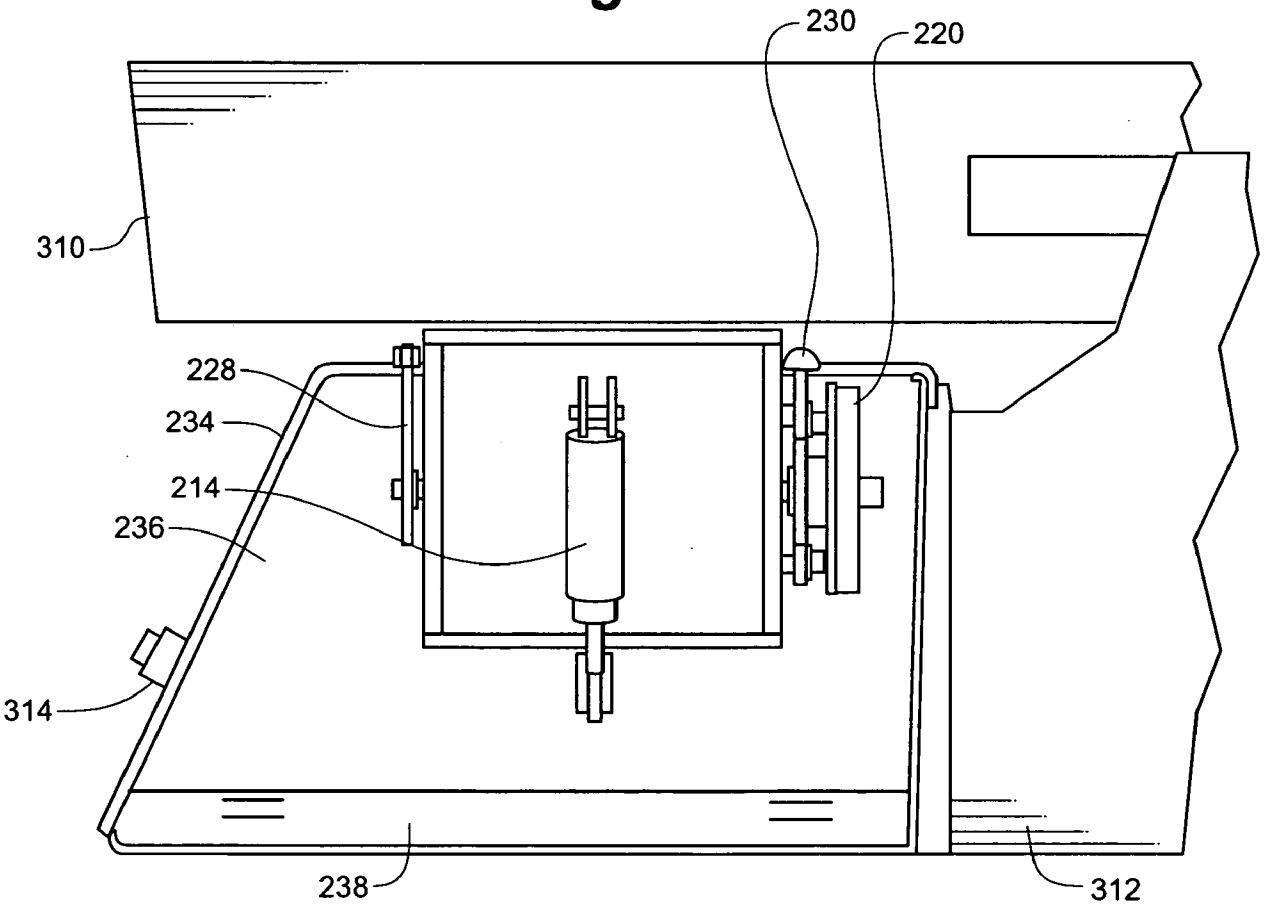
FIG. 12 is a side view of the ink proofer arrangement illustrated in FIG. 11.
Figure 12B:
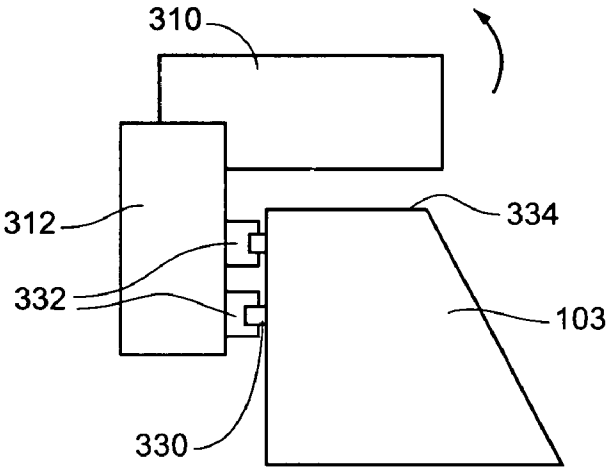
FIG. 12*b* is a side view of the ink proofer arrangement illustrated in FIG. 11.
Figure 12A:
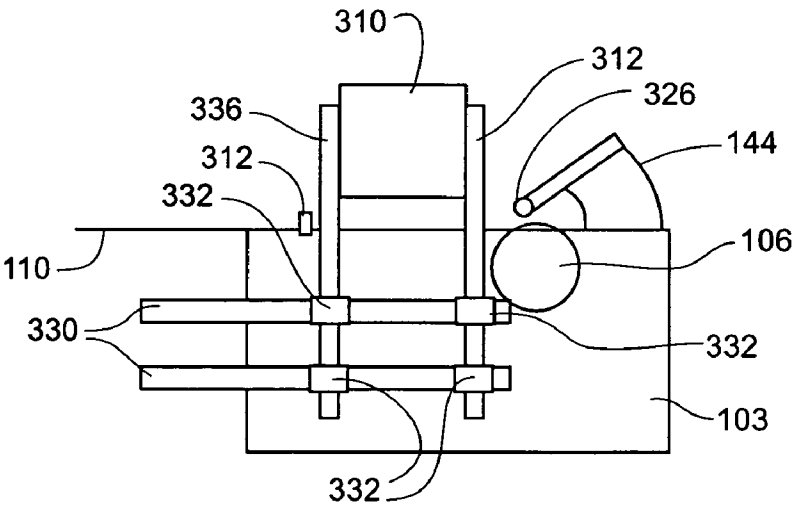
FIG. 12*a* is a back view of the ink proofer arrangement illustrated in FIG. 11.

FIG. 12 illustrates a switch 314 for operating UV lamp 310, the switch being mounted to the housing of ink proofer arrangement 300. In a related embodiment, UV lamp 310 is operated by on/off switch 120. FIGS. 12A and 12B provide views of rails 330, mounting bracket 312 and UV lamp 310 attached to ink proofer housing 103.

Figure 13:
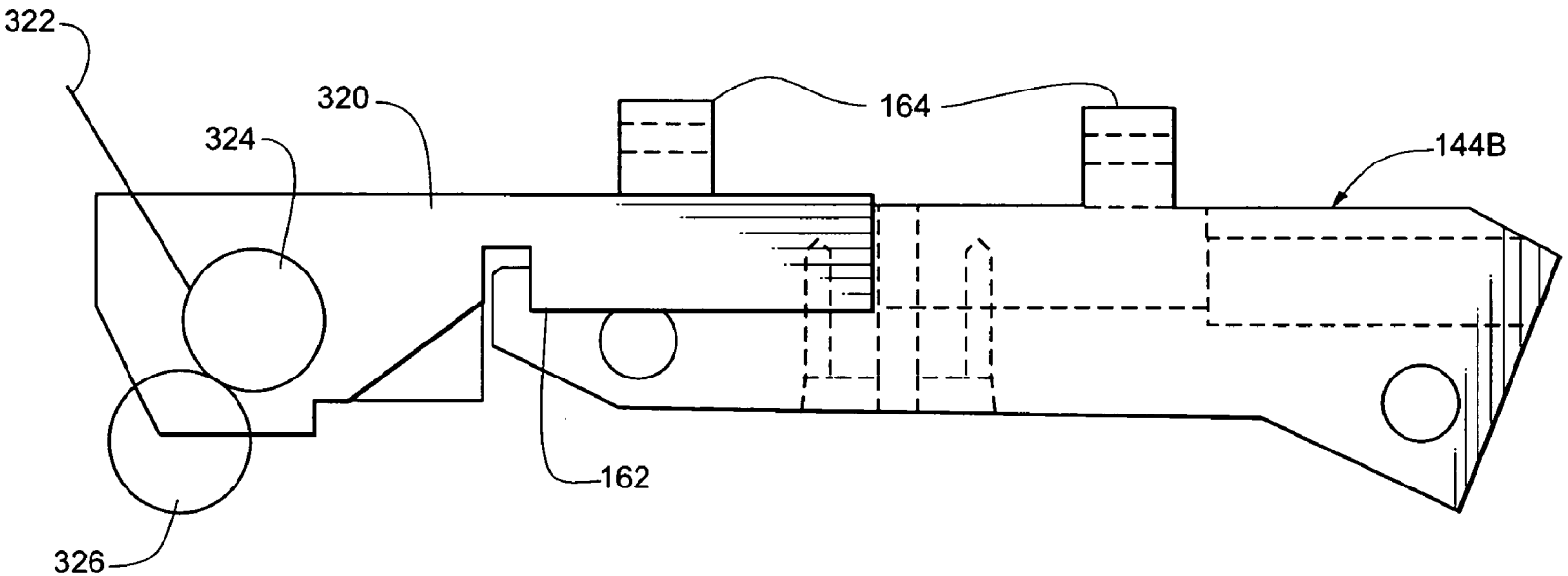
FIG. 13 is a side view of a universal proofer holder with a detachable ink proofer cartridge mounted thereon.

Referring now to FIG. 13, there is illustrated another embodiment of the ink proofer apparatus of the invention. In particular, the ink proofer apparatus is comprised of an ink proofer tool cartridge assembly 320 that is configured to sit within universal proofer holder 144B. Proofer tool cartridge assembly 320 is detachable, allowing for easy removal from universal holder 144B for ease of cleaning and/or changeover to another ink color or type. Proofer tool cartridge assembly 320 includes a doctor blade 322, an anilox roll 324, and a transfer roll 326.

Figure 14:
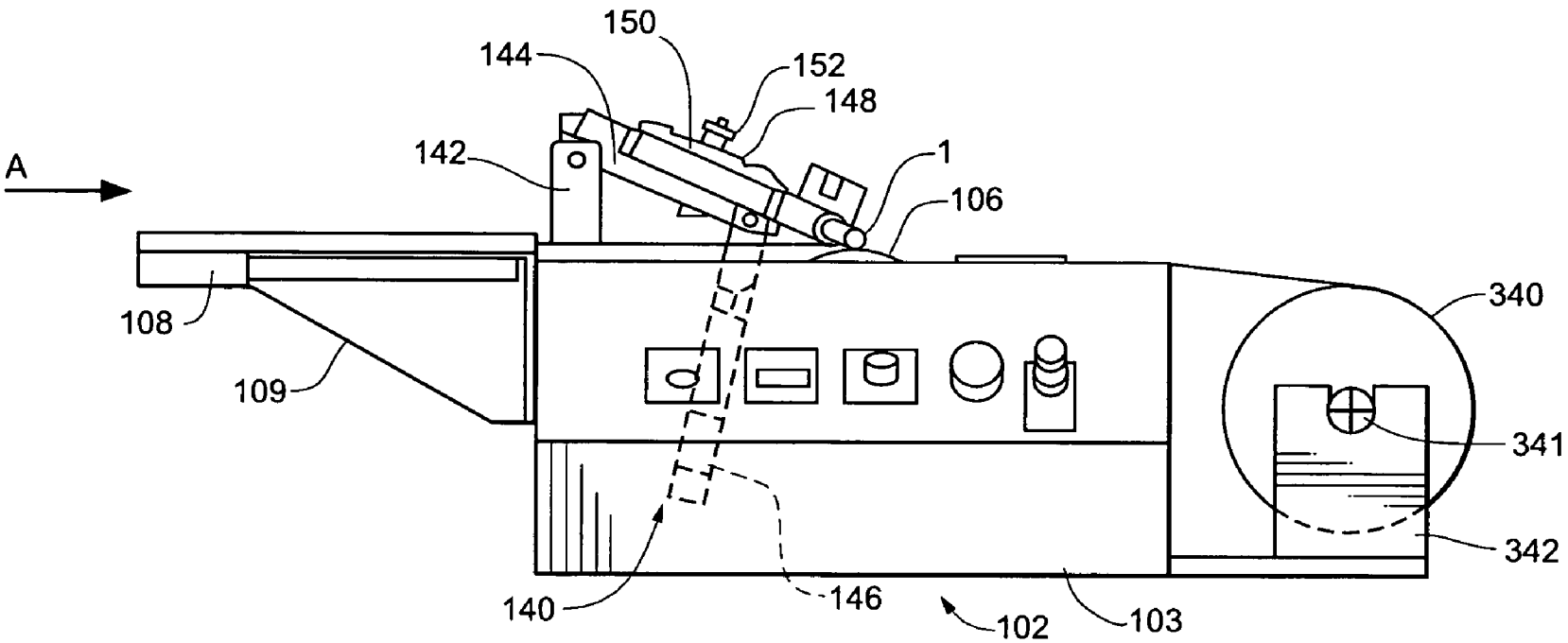
FIG. 14 is a side elevational view of another embodiment of the ink proofer with a take-up roll arrangement being depicted in phantom.
Figure 16:
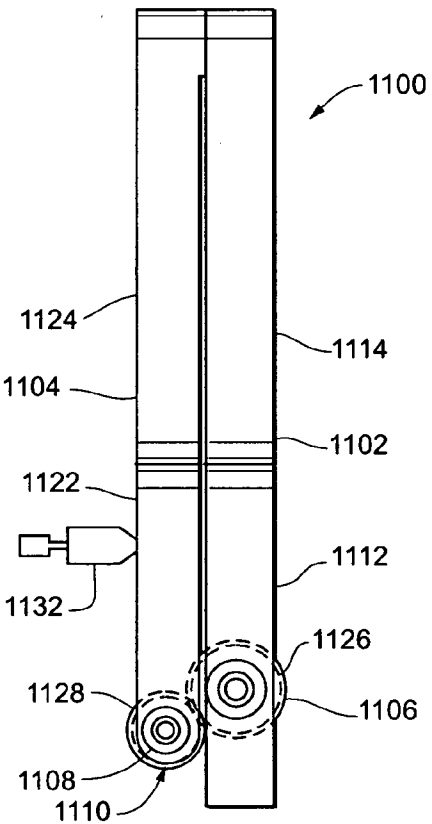
FIG. 16 is an elevational view of a proofing tool in accordance with the present invention.
Figure 15:
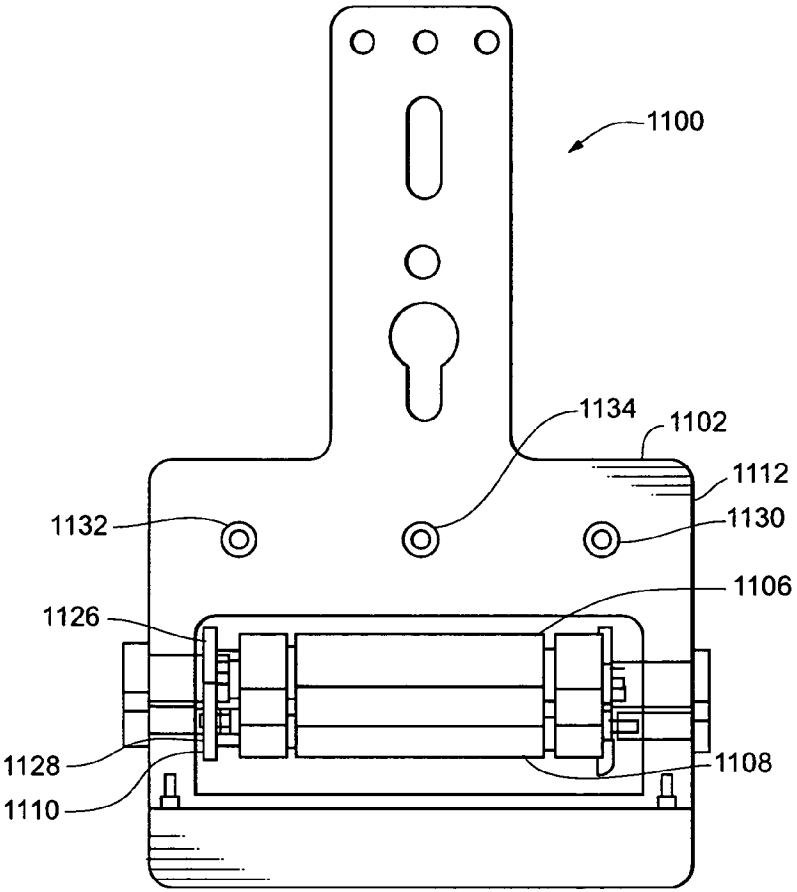
FIG. 15 is a plan view of a proofing tool in accordance with the present invention.
Figure 17:
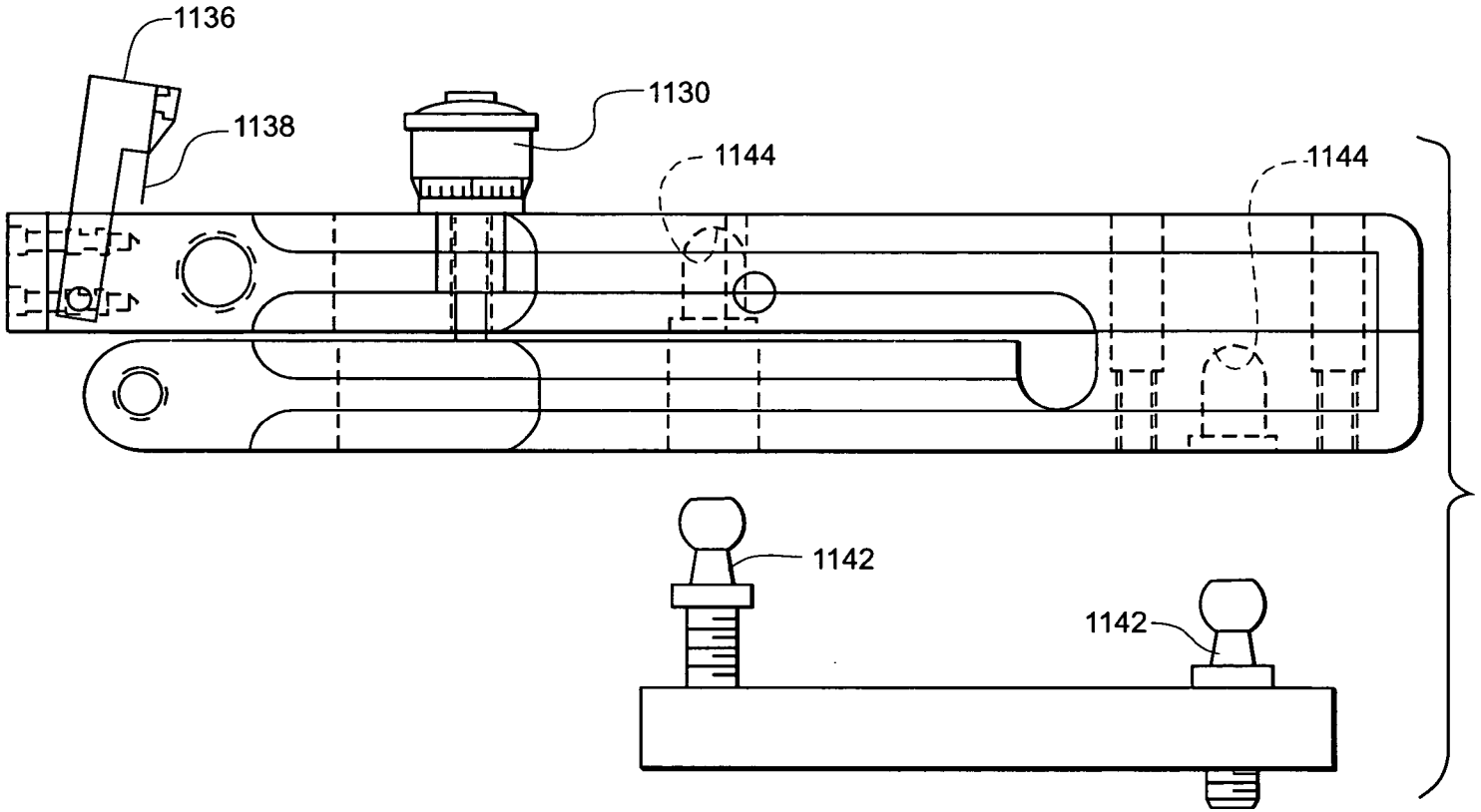
FIG. 17 is an elevational view of a proofing tool in accordance with the present invention.
Figure 18:
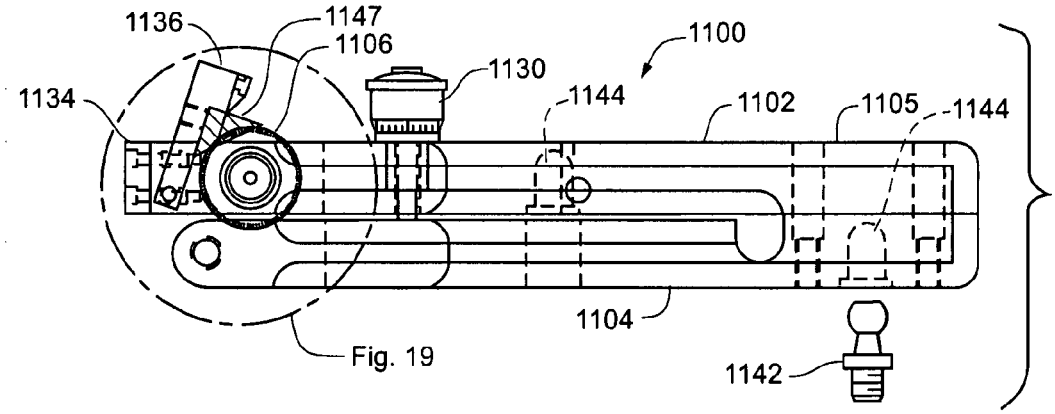
FIG. 18 is an elevational view of the proofing tool of FIG. 17.
Figure 19:
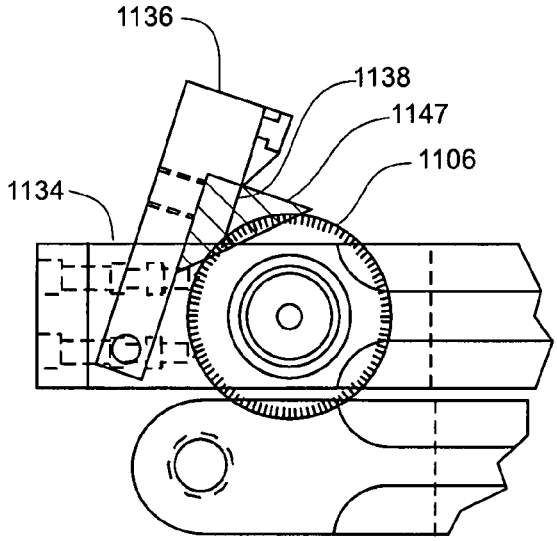
FIG. 19 is a detailed view taken from FIG. 18.
Figure 20:
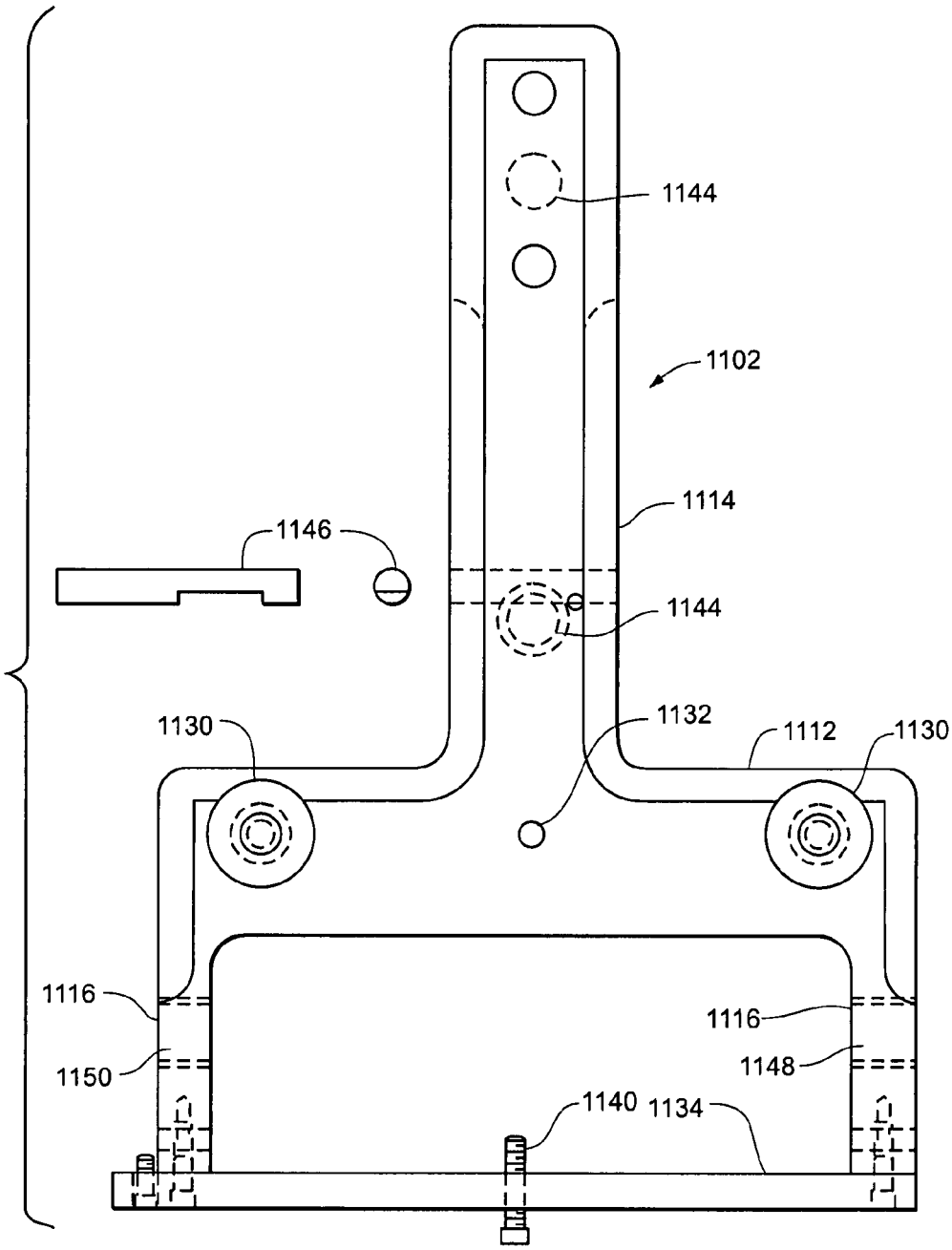
FIG. 20 is an elevational view of an anilox support in accordance with the present invention.

Referring now to FIG. 14, there is illustrated an example embodiment of a take-up roll arrangement 340 that may be retroactively attached to any of the ink proofer arrangements disclosed herein. In this example embodiment, take-up roll 340 is disposed on a rod 341 which is disposed on a roll support frame 342 located at the opposite end of the ink proofer away from supply roll 240, such as in FIG. 9. Take-up roll 340 is preferably configured to be pneumatically powered so as to take up the inked substrate at the outlet end of the proofer. Hence, after the substrate has passed from the inlet end of the ink proofer, between ink proofer tool 1 and roller 106, such as in FIG. 4, the inked substrate travels off the end of base unit 102 and is wound onto take-up roll 340. In this example embodiment, roll support 342 includes at least one bracket for mounting take-up roll 340 through a rod 341. The addition of powered take-up roll 340 provides for the ability of the present invention to have more control of the speed at which the substrate moves through the device and therefore more control of ink smears created by the proofer tool.

Referring again to FIG. 9, in yet another example embodiment, a substrate roll support (not shown) is adapted to be mounted above or below base unit 102 at a feeding end of the proofer apparatus before the substrate is proofed. In this example embodiment, roll support holds multiple substrate rolls, ideally in a vertical (and parallel) configuration, allowing a technician the choice of multiple substrates available for ink proof sample generation. In this example embodiment, four rolls are used. In an alternative embodiment, roll support is not attached directly to base unit 102, but is free standing and located proximate to base unit 102 near its feeding end.

Figure 10A:
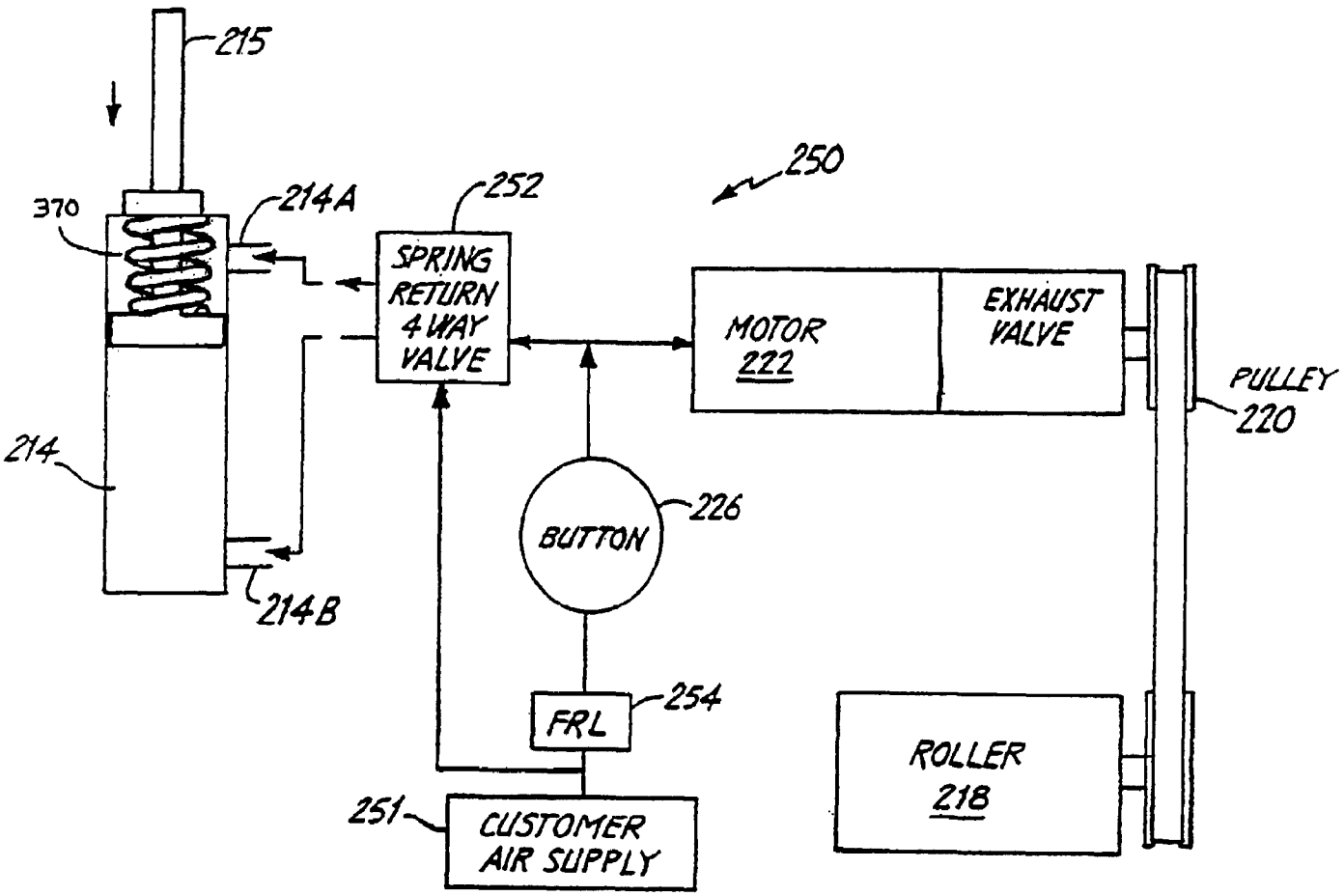
Figure 11:
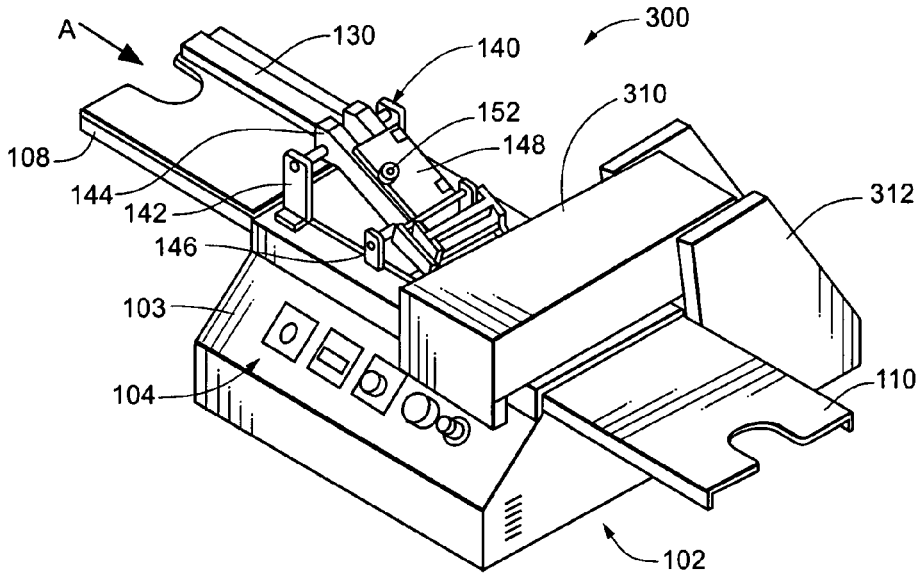
FIG. 11 is a perspective view of another embodiment of an ink proofer arrangement of the present invention.
Figure 11A:
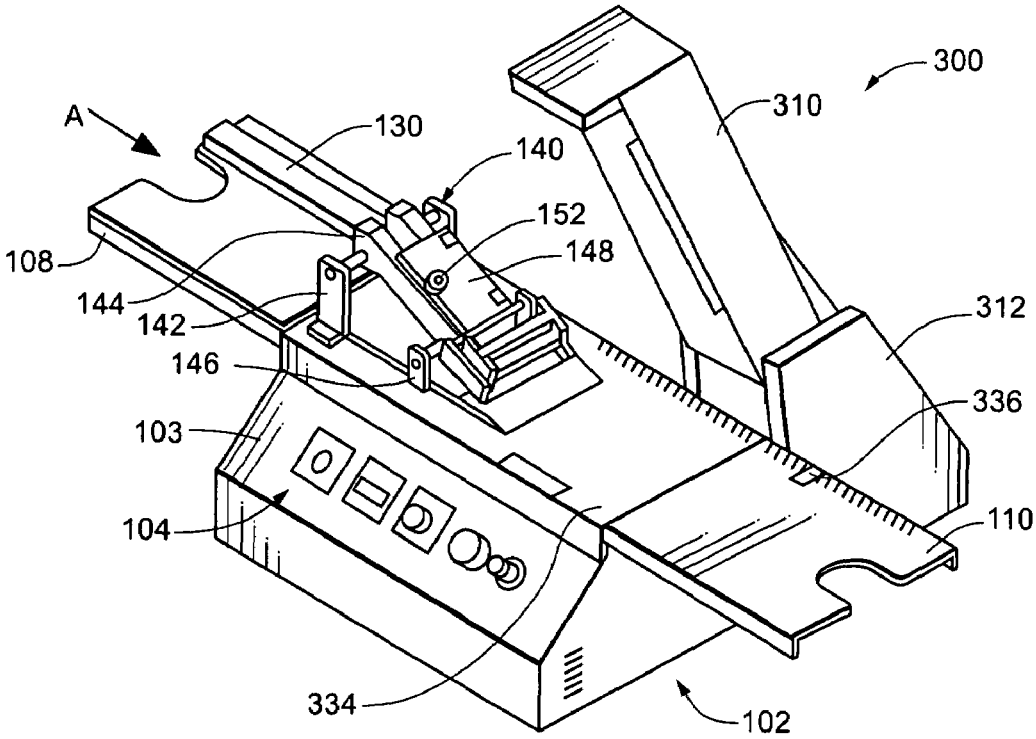
FIG. 11*a* is a perspective view of another embodiment of an ink proofer arrangement of the present invention.

Referring back to FIGS. 8A and 10A, in a related example embodiment of system 250 pressure cylinder 214 is adapted to include a spring 370 disposed within pressure cylinder 214. Spring 370 causes a force to be applied to plunger 215, which in turn pulls unit body 210 and ink proofer tool 1 downward onto and into a contact position with roller 218. In another related embodiment, spring 370 is adjustable so as to allow a range of pressures.

In an embodiment of the invention the proofing tool may be as described below. Referring to FIGS. 15-20, proofing tool 1100 generally includes anilox support impression support 1104, anilox roll 1106, impression roll 1108 and positive roll drive 1110. Anilox support 1102 and impression support 1104 are similar but not identical structures. The proofing tool includes a doctor blade that is not shown in FIGS. 15 and 16 for clarity. An exemplary doctor blade and pressure bar are depicted in FIGS. 17-20.

Anilox support 1102 generally includes yoke 1112 and extended portion 1114. Yoke portion supports anilox roll 1106 between two arms 1116. Likewise, impression support 1104 includes yoke 1122 and extended portion 1124. Anilox roll 1106 and impression roll 1108 are supported between the arms of yoke 1112 and yoke 1122 respectively. Anilox support 1102 and impression support 1104 are connected only at a distal end 1125 of extended portion 1120 and 1124. Otherwise, anilox support 1102 and impression support 1104 are substantially parallel with a small gap between them.

Positive roll drive 1110 generally includes anilox gear 1126 and impression gear 1128. Anilox gear 1126 and impression gear 1128 mesh together to synchronize the motion of anilox roll and impression roll 1108. In one embodiment of the invention there is a single pair of anilox gear 1126 and impression gear 1128 in another embodiment of the invention there are two pairs of anilox gear 1126 and impression gear 1128. If there are two pairs of anilox gears 1126 and impression gears 1128, one pair located at each end of the anilox roll 1106 and impression roll 1108.

Proofing tool 1100 also includes one or more micrometer thimbles 1130.

Desirably two micrometer thimbles 1130 are used to allow adjustment to ensure equal contact across the width of the anilox roll 1106 and the impression roll 1108. The gear teeth of impression gear 1128 extend beyond impression roll 1108, in part, so that if the proofing tool 1100 is set down on a flat surface there will be a standoff created and impression roll 1108 will not touch the surface.

Optionally, proofing tool 1100 may include a separation device 1132 which can be utilized to force anilox support 1102 apart from impression support 1104 a slight distance to ensure separation between anilox roll 1106 and impression roll 1108 when not in use. Desirably, anilox gear 1126 and impression gear 1128 are formed with fine pitch gear teeth to prevent gear chatter or gearing.

Desirably the gear teeth mesh such that the gears are separated by slightly more then a true pitch diameter to allow for adjustment of nip without the need to change gears.

Proofing tool 1100 may be formed from aluminum alloy.

Proofing tool 1100 includes pressure bar 1134, doctor blade holder 1136 and doctor blade 1138. Pressure bar 1134 is located at the end of yoke 1122. Doctor blade holder 1136 is pivotably secured to the arms of yoke 1122. Doctor blade holder 1136 secures doctor blade 1138 preferably by clamping. Doctor blade holder 1136 has a relief cut into it, to allow positioning of the doctor blade 1138 precisely parallel to anilox roll 1136. Adjusting screw 1140 passes through pressure bar 1134 to bear on doctor blade holder 1136. Adjusting screw 1140 adjust the pressure of doctor blade 1138 on anilox roll 1106. Doctor blade holder 1136 is pivotably attached to arms 1116 of yoke 1118.

Doctor blade 1138 desirably meets anilox roller 1106 at approximately a 30 degree pressure angle. If the diameter of the anilox rolls 1106 is changed it may be necessary to change doctor blade holder 1136 or to relocate the pivotable mounting of doctor blade holder 1136.

Ball ends 1142 may be used to removably secure proofing tool 1100 to an automated proofing machine (not shown.) If ball ends 1142 are utilized, proofing tool 100 includes ball sockets 1144 to receive ball ends 1142 therein. Proofing tool 1100 may also include one or more slide lockpins 1146 located in an aperture in proofing tool 1100 to secure proofing tool 1100 to one or more ball ends 1142 at ball sockets 1144.

The orientation of the doctor blade 1138 in the present invention is reversed from that in conventional prior art proofing tools. This orientation allows the introduction of a felt dam 1147 adjacent to the doctor blade 1138. The application of a felt dam 1147 allows for the maintenance of a larger volume of ink in the well adjacent the doctor blade 1138 which is useful, particularly, in long draw downs.

Note that extended portion 1115 and extended portion 1120 of anilox support 1102 and impression support 1104 may be milled to thin them. The level of milling can be adjusted to adjust the flexibility of anilox support 1102 relative to impression support 1104 allowing for adjustment of the relative flexion of anilox support 1102 relative to impression support 1104.

Anilox roll 106 may be supported in anilox support 1102 by precision ball bearings. Impression roll 1108 may be supported at a first end by fixed bearing 1148 and at a second end by moveable bearing 1150. Fixed bearing 1148 and moveable bearing 1150 may be DELRIN bearings. Moveable bearing 1150 may be adjustable so as to be loosened to remove impression roll 1108 and tighten to secure impression roll 1108 in place for use.

In another embodiment of the invention, the drive roll of a proofing machine (not shown) may include a drive roll gear such that impression gear 1128 engages the drive roll gear so that the drive roll gear drives impression gear 1128 which in turn drives anilox gear 1126. Providing a positive drive engagement between a drive roll (not shown), impression roll 1108 and anilox roll 1106.

The various embodiments of the present invention provide ink proofer arrangements, primarily directed to the flexographic field, that are portable and provide the advantages of constant speed and constant pressure to enable repeatability of ink proofs irrespective of the experience of the ink proofer arrangement user.

The present invention may be embodied in other specific forms without departing from the essential attributes thereof; therefore, the illustrated embodiments should be considered in all respects as illustrative and not restrictive, reference being made to the appended claims rather than to the foregoing description to indicate the scope of the invention.

What is claimed is:

1. An ink proofer arrangement adapted to be used with an ink proofer tool, the ink proofer tool including an ink transfer roller, comprising:

a housing;

a cylindrical drum roller;

a drive motor operatively connected to the cylindrical drum roller to rotate the drum roller;

a first movable mounting assembly coupled to the ink proofer tool and designed to retain the ink proofer tool adjacent to and in a non-contact position with the drum roller, the moveable mounting assembly being further adapted to move in concert with the retained ink proofer tool;

a first pressure assembly operatively coupled to the mounting assembly to move the movable mounting assembly and the retained ink proofer tool such that the retained ink proofer tool is moved into contact with the drum roller and further, to move the ink proofer tool into the non-contact position, wherein the ink transfer roller transfers ink to a substrate that is inserted between the drum roller and the transfer roller of the ink proofer tool in response to the drive motor being engaged; and a light source operably attached to the housing and disposed along a linear path of travel of the substrate defined generally transverse to an interface of the ink transfer roller and the drum roller.

2. The ink proofer arrangement of claim 1, wherein the light source cures the ink transferred to the substrate that has been inserted between the drum roller and the transfer roller of the ink proofer tool.

3. The ink proofer arrangement of claim 1, wherein the light source is disposed above a top surface of the housing.

4. The ink proofer arrangement of claim 1, further comprising a stopping device positioned on the top surface of the housing between the interface of the ink transfer roller and the drum roller, and the end of the housing distal the first movable mounting assembly, wherein the stopping device fixes the position of the light source.

5. The ink proofer arrangement of claim 1, wherein the distance between the interface of the ink transfer roller and the drum roller, and a position of the light source comprises an ink wicking dwell time.

6. The ink proofer arrangement of claim 5, wherein the ink wicking dwell time is adjustable by varying the placement of the light source along the path of travel relative to the interface of the ink transfer roller and the drum roller.

7. The ink proofer arrangement of claim 1, further comprising a sensor assembly operatively connected to the light source to move the light source between an on/off position with respect to the substrate.

8. The ink proofer arrangement of claim 7, wherein the sensor assembly is mounted adjacent the light source, detects a leading edge of the substrate, activates the light source, detects a terminal edge of the substrate, and deactivates the light source.

9. The ink proofer arrangement of claim 8, wherein the sensor assembly is selected from the group consisting of visual sensors, mechanical sensors, vacuum sensors, air logic sensors and a combination of the foregoing.

10. The ink proofer arrangement of claim 1, further comprising a support plate having a top surface and a bottom surface, wherein the support plate is attached to a top edge of the housing distal the first movable mounting assembly, thereby extending a length of the housing.

11. The ink proofer arrangement of claim 10, further comprising a set of markings on the top surface of the housing and on the top surface of the support plate, such that a position of the light source along the top surface of the housing or along the top surface of the support plate can be recorded.

12. The ink proofer arrangement of claim 1, wherein the light source is an ultra-violet lamp.

13. An ink proofer arrangement adapted to be used with an ink proofer tool, the ink proofer tool including an ink transfer roller, comprising:

a housing;

a cylindrical drum roller;

a drive motor operatively connected to the cylindrical drum roller to rotate the drum roller;

a first movable mounting assembly coupled to the ink proofer tool and designed to retain the ink proofer tool adjacent to and in a non-contact position with the drum roller;

a first pressure assembly operatively coupled to the mounting assembly to move the ink proofer tool into contact with the drum roller and further, to move the ink proofer tool into the non-contact position, wherein the ink transfer roller transfers ink to a substrate that is inserted between the drum roller and the transfer roller of the ink proofer tool in response to the drive motor being engaged; and a light source operably attached to the housing and disposed along a linear path of travel of the substrate defined generally transverse to an interface of the ink transfer roller and the drum roller; and at least one rail affixed to a long side of the housing and extending from at least the position of the interface of the ink transfer roller and the drum roller to at least an end of the housing distal the first movable mounting assembly, and a mounting bracket operatively slidably coupled to the at least one rail.

14. The ink proofer arrangement of claim 13, wherein the light source is operatively attached to the mounting bracket, forming a slidably traveling unit.

15. The ink proofer arrangement of claim 14, wherein the light source is slidably movable between the interface of the ink transfer roller and the drum roller, and at least the end of the housing distal the first movable mounting assembly.

16. An ink proofer arrangement adapted to be used with an ink proofer tool, the ink proofer tool including an ink transfer roller, comprising:

a housing, comprising a top surface, a bottom surface and four side surfaces;

a cylindrical drum roller;

a drive motor operatively connected to the cylindrical drum roller to rotate the drum roller;

a movable mounting assembly comprising a unibody frame to support and to retain the ink proofer tool adjacent to and in a non-contact position with the drum roller, the moveable mounting assembly being further adapted to move in concert with the retained ink proofer tool;

a movable support assembly adapted to support the drum roller;

a first pressure assembly operatively coupled to the mounting assembly to move the movable mounting assembly and the retained ink proofer tool such that the retained ink proofer tool is moved into contact with the drum roller and further, to move the ink proofer tool into the non-contact position, wherein the ink transfer roller transfers ink to a substrate that is inserted between the drum roller and the transfer roller of the ink proofer tool in response to the drive motor being engaged; and a light source movably attached to the housing and disposed along a linear path of travel of the substrate defined generally transverse to an interface of the ink transfer roller and the drum roller.

17. The ink proofer arrangement of claim 16, wherein the light source cures the ink transferred to the substrate.

18. The ink proofer arrangement of claim 16, further comprising a movable bracket positioned between the interface of the transfer roller and the drum roller, and the end of the housing, wherein the light source is pivotally affixed to the bracket.

19. The ink proofer arrangement of claim 16, wherein the light source is disposed above the top surface of the housing and pivots vertically away from the top surface of the housing.

20. The ink proofer arrangement of claim 16, wherein the light source is an ultra-violet light.

* * * * *